US008569979B2

(12) United States Patent
Kokubo et al.

(10) Patent No.: US 8,569,979 B2
(45) Date of Patent: Oct. 29, 2013

(54) CHARGED PARTICLE ACCELERATOR AND CHARGED PARTICLE ACCELERATION METHOD

(75) Inventors: Yuji Kokubo, Kobe (JP); Masatoshi Ueno, Moriya (JP); Masumi Mukai, Abiko (JP); Masahiko Matsunaga, Shinjuku-ku (JP)

(73) Assignee: Quan Japan Co., Ltd., Kobe-shi (JP)

( * ) Notice: Subject to any disclaimer, the term of this patent is extended or adjusted under 35 U.S.C. 154(b) by 0 days.

(21) Appl. No.: 13/522,476

(22) PCT Filed: Apr. 25, 2011

(86) PCT No.: PCT/JP2011/060044

§ 371 (c)(1),
(2), (4) Date: Jul. 16, 2012

(87) PCT Pub. No.: WO2011/136168

PCT Pub. Date: Nov. 3, 2011

(65) Prior Publication Data

US 2013/0033201 A1 Feb. 7, 2013

(30) Foreign Application Priority Data

Apr. 26, 2010 (JP) ..... 2010-101291

(51) Int. Cl.
*H05H 7/00* (2006.01)

(52) U.S. Cl.
USPC ..... 315/506; 315/505

(58) Field of Classification Search
USPC ..... 315/500, 501, 505, 506
See application file for complete search history.

(56) References Cited

U.S. PATENT DOCUMENTS

| | | | | |
|---|---|---|---|---|
| 3,218,562 | A | 11/1965 | Serduke | |
| 5,117,194 | A * | 5/1992 | Nakanishi et al. | 315/503 |
| 5,401,973 | A * | 3/1995 | McKeown et al. | 250/492.3 |
| 5,600,213 | A * | 2/1997 | Hiramoto et al. | 315/507 |
| 5,744,919 | A * | 4/1998 | Mishin et al. | 315/505 |
| 5,789,875 | A * | 8/1998 | Hiramoto et al. | 313/505 |
| 7,259,529 | B2 * | 8/2007 | Tanaka | 315/501 |
| 7,550,753 | B2 * | 6/2009 | Shigehiro et al. | 250/505.1 |
| 8,188,688 | B2 * | 5/2012 | Balakin | 315/503 |

FOREIGN PATENT DOCUMENTS

| | | |
|---|---|---|
| JP | 08-022786 | 1/1996 |
| JP | 08-213197 | 8/1996 |
| JP | 11-144897 | 5/1999 |
| JP | 2001-110600 | 4/2001 |
| JP | 2005-209424 | 8/2005 |
| JP | 2006-032282 | 2/2006 |
| JP | 2007-265966 | 10/2007 |

OTHER PUBLICATIONS

English-language abstract of Japanese Patent Publication No. 2001-110600, Japan Patent Office, Apr. 20, 2001.

(Continued)

*Primary Examiner* — Thuy Vinh Tran
(74) *Attorney, Agent, or Firm* — DASCENZO Intellectual Property Law, P.C.

(57) ABSTRACT

A cascade of accelerating electrode tubes (LA#1 to LA#28) that apply an accelerating electric potential to a charged particle (2) are provided. With a controller (8) appropriately controlling timings to apply an accelerating voltage to the accelerating electrode tubes (LA#1 to LA#28), accelerating energy can be gained each time the charged particle (2) passes through gaps between the accelerating electrode tubes (LA#1 to LA#28).

19 Claims, 36 Drawing Sheets

(56) References Cited

OTHER PUBLICATIONS

English-language abstract of Japanese Patent Publication No. 2005-209424, Aug. 4, 2005.
English-language abstract of Japanese Patent Publication No. 2006-032282, Japan Patent Office, Feb. 2, 2006.
English-language machine translation of Japanese Patent Publication No. 2006-032282, Japan Patent Office, Feb. 2, 2006.
English-language abstract of Japanese Patent Publication No. 2007-265966, Japan Patent Office, Oct. 11, 2007.
English-language translation of Japanese Patent Publication No. 2007-265966, Oct. 11, 2007.
Masugata, K., "Proposal of an electrostatic multi-stage accelerator for high-current pulsed ion beam," Nuclear Instruments and Methods in Physics Research A., vol. 399, No. 1, Jun. 10, 1997, pp. 1-4, XP002693606.
Masugata, K., "A high current pulsed ion beam accelerator using bi-directional pulses," Nuclear Instruments and Methods in Physics Research A, vol. 411, No. 2-3, Feb. 1, 1998, pp. 205-209, XP004133269.
English-language abstract of Japanese Patent Publication No. 08-022786, Japan Patent Office, Jan. 23, 1996.
English-language abstract of Japanese Patent Publication No. 08-213197, Japan Patent Office, Aug. 20, 1996.
English-language abstract of Japanese Patent Publication No. 11-144897, Japan Patent Office, May 28, 1999.
Notice of Preliminary Rejection issued in connection with related Korean Patent Application No. 10-2012-7030821, Korean Intellectual Property Office, Apr. 15, 2013.
English-language translation of Notice of Preliminary Rejection issued in connection with related Korean Patent Application No. 10-2012-7030821, Korean Intellectual Property Office, Apr. 15, 2013.

* cited by examiner

CHARGED PARTICLE ACCELERATOR AND CHARGED PARTICLE ACCELERATION METHOD

TECHNICAL FIELD

The present invention relates to a charged particle accelerator that accelerates charged particles and a method for accelerating charged particles. More specifically, the present invention relates to a linear trajectory accelerator and a spiral trajectory accelerator that generate accelerating electric fields using a combination of a high-voltage pulse generation device and a controller, and to a method for accelerating charged particles using these charged particle accelerators.

BACKGROUND ART

FIGS. 23A and 23B show a configuration of a conventional charged particle accelerator described in Patent Document 1 listed below. This charged particle accelerator is a cyclotron, which is a representative example of a charged particle accelerator with a spiral trajectory. In FIGS. 23A and 23B, 70 denotes a magnet, 71 and 72 denote accelerating electrodes, and 73 denotes a radio-frequency power supply that supplies an accelerating radio-frequency voltage to the accelerating electrodes 71 and 72. Furthermore, 74 denotes a charged particle that is accelerated by the accelerating electrodes 71 and 72.

In the cyclotron, a period $T_p$ of revolution of the charged particle 74 satisfies the relationship $T_p=2\pi m/eB$, where n denotes the ratio of the circle's circumference to its diameter, m denotes the mass of the charged particle 74, e denotes the electric charge of the charged particle 74, and B denotes the magnetic flux density on a particle trajectory attributed to the magnet 70. Therefore, provided that m/eB is constant, the period of revolution of the charged particle 74 is constant regardless of the radius of revolution. For example, when a period $T_{rf}$ of the accelerating radio frequency of the radio-frequency power supply 73 satisfies the relationship $T_{rf}=T_p/2$, the charged particle 74 is constantly accelerated in an electrode gap between the accelerating electrodes 71 and 72, and therefore can be accelerated to a high energy.

When the speed of the charged particle 74 approaches the speed of light, the value of the mass m of the charged particle 74 increases due to relativistic effects. As a result, in the cyclotron shown in FIGS. 23A and 23B, the isochronous properties cannot be ensured when the accelerating energy of the charged particle 74 increases to the extent that its speed approaches the speed of light, thus making it impossible to continue further acceleration. As a countermeasure against the above issue, it has been suggested to, for instance, change the magnetic flux density or the period of the accelerating radio frequency in accordance with an increase in the accelerating energy.

CITATION LIST

Patent Document

Patent Document 1: JP 2006-32282A

SUMMARY OF INVENTION

Problem to be Solved by the Invention

The above conventional charged particle accelerator with the spiral trajectory is problematic in that the energy gain cannot be increased due to the loss of the isochronous properties in a relativistic energy range, and it requires a function of changing the accelerating radio-frequency voltage or magnetic field distribution to correct the loss of the isochronous properties, which results in an increase in the number of device components and the cost.

The present invention has been conceived to solve the aforementioned problem with conventional configurations, and its main object is to provide a charged particle accelerator and a method for accelerating charged particles that are less expensive and yield a higher energy gain than the conventional ones.

Means for Solving Problem

In order to solve the above problem, one aspect of the present invention is a charged particle accelerator including: a charged particle generation source for emitting a charged particle; an accelerating electrode tube through which the charged particle emitted from the charged particle generation source passes and which is for accelerating the charged particle that passes; a drive circuit for applying voltage for accelerating the charged particle to the accelerating electrode tube; and a control unit for controlling the drive circuit so that application of the voltage to the accelerating electrode tube is started while the charged particle is traveling through the accelerating electrode tube.

With respect to the above aspect, it is preferable that the accelerating electrode tube be provided in plurality, the plurality of accelerating electrode tubes be arranged in a linear fashion, the charged particle emitted from the charged particle generation source pass through the plurality of accelerating electrode tubes in sequence, and the control unit control the drive circuit to start applying the voltage to any accelerating electrode tube through which the charged particle is traveling, thus applying the voltage to the plurality of accelerating electrode tubes in sequence.

Furthermore, with respect to the above aspect, it is preferable that the charged particle accelerator further include a bending magnet for changing a traveling direction of the charged particle that has passed through the accelerating electrode tube.

Furthermore, with respect to the above aspect, it is preferable that the bending magnet change the traveling direction of the charged particle that has passed through the accelerating electrode tube so as to cause the charged particle to pass through the same accelerating electrode tube again, and the control unit control the drive circuit to start applying the voltage to the accelerating electrode tube while the charged particle is traveling through the accelerating electrode tube, thus applying the voltage to the same accelerating electrode tube multiple times.

Furthermore, with respect to the above aspect, it is preferable that the charged particle accelerator further include an adjustment unit for adjusting the traveling direction of the charged particle to a direction that intersects the traveling direction.

Furthermore, with respect to the above aspect, it is preferable that the charged particle accelerator further include an ammeter for measuring an accelerating current that is generated in an accelerating electrode tube when the charged particle passes through the accelerating electrode tube, and the control unit adjust a timing to start applying voltage to an accelerating electrode tube based on a result of measurement of the accelerating current by the ammeter.

Furthermore, with respect to the above aspect, it is preferable that the drive circuit be capable of changing a value of voltage applied to an accelerating electrode tube.

Furthermore, with respect to the above aspect, it is preferable that the charged particle accelerator further include a detection unit for detecting whether or not the charged particle accelerated by an accelerating electrode tube is traveling along a predetermined trajectory, and the control unit stop the drive circuit when the detection unit has detected that the charged particle is not traveling along the predetermined trajectory.

Another aspect of the present invention is a method for accelerating a charged particle, including: a step of emitting the charged particle from a charged particle generation source so as to cause the charged particle to pass through a plurality of accelerating electrode tubes in sequence; and a step of starting to apply voltage for accelerating the charged particle to any accelerating electrode tube through which the charged particle is traveling, thus applying the voltage to the plurality of accelerating electrode tubes in sequence.

Effect of the Invention

A charged particle accelerator and a method for accelerating charged particles pertaining to the present invention are less expensive and yield a higher energy gain than the conventional ones.

DESCRIPTION OF EMBODIMENTS

A description is now given of embodiments of the present invention with reference to the drawings and tables.

Embodiment 1

Figure 1:
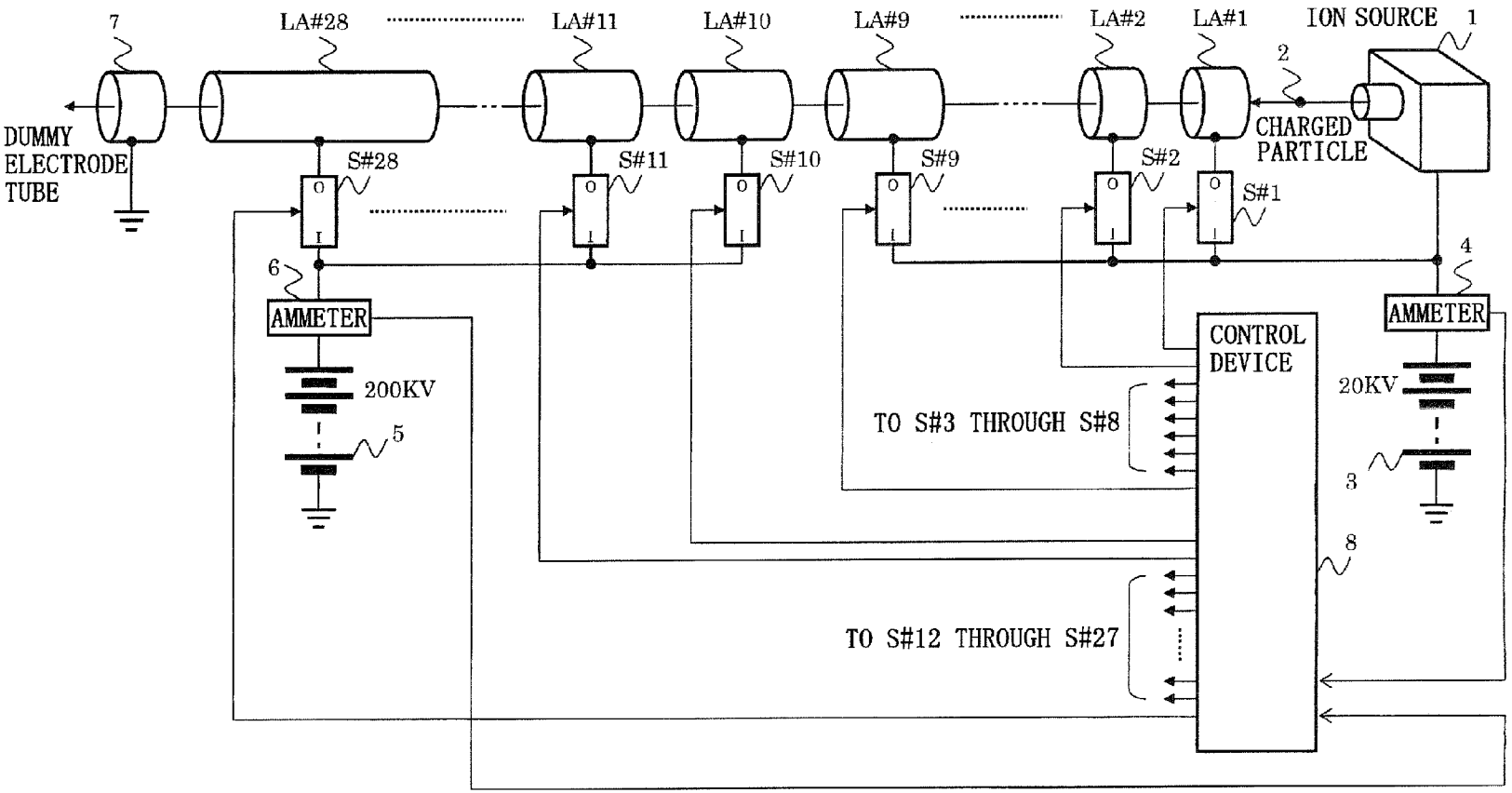
FIG. 1 shows a configuration of a charged particle accelerator with a linear trajectory pertaining to Embodiment 1.

FIG. 1 shows a configuration of a charged particle accelerator with a linear trajectory pertaining to Embodiment 1 of the present invention. In FIG. 1, 1 denotes an ion source, 2 denotes a charged particle extracted from the ion source, and LA#1 to LA#28 denote 28 accelerating electrode tubes for accelerating the charged particle 2. They are arranged in a linear fashion (along a straight line) together with a dummy electrode tube 7 at the end. Furthermore, 3 denotes a 20-kV direct current power supply, and an output thereof is connected to the I terminals of nine switching circuits S#1 to S#9 via an ammeter 4. Similarly, 5 denotes a 200-kV direct current power supply, and an output thereof is connected to the I terminals of 19 switching circuits S#10 to S#28 via an ammeter 6. Furthermore, 8 denotes a controller that is connected to outputs of the ammeters 4 and 6. The O terminals of the switching circuits S#1 to S#28 are connected to the accelerating electrode tubes LA#1 to LA#28. An output of the controller 8 is connected to the switching circuits S#1 to S#28, and it is possible to switch between the switching circuits under instructions from the controller 8.

The following describes operations of the linear-trajectory charged particle accelerator configured in the above manner. Note that the following description provides a representative example in which a hexavalent carbon ion is accelerated. The 20-kV direct current power supply 3 constantly applies a voltage of 20 kV to the ion source 1. When the controller 8 outputs "1", the switching circuits S#1 to S#28 connect the O terminals and the I terminals and output the same voltage as the voltage applied to the I terminals from the O terminals. On the other hand, when the controller 8 outputs "0", the outputs from the O terminals are at ground potential. In an initial state prior to the acceleration, the controller 8 outputs "1" only to the switching circuit S#1 and outputs "0" to the remaining switching circuits S#1 to S#28. In other words, in the initial state, only the accelerating electrode tube LA#1 has an electric potential of 20 kV, and the remaining accelerating electrode tubes LA#2 to LA#28 are all at ground potential. Therefore, in the initial state, the charged particle 2 is not extracted because the ion source 1 and the accelerating electrode tube LA#1 have the same electric potential.

In order to perform an accelerating operation, the controller 8 first outputs "0" to the switching circuit S#1 for a predetermined time period so as to place the accelerating electrode tube LA#1 at ground potential. When the accelerating electrode tube LA#1 is at ground potential, the charged particle 2 (hexavalent carbon ion) is extracted from the ion source 1. The ion source 1 has been adjusted such that the ion current is 1 mA and the ion beam diameter is 5 mm. For example, if the accelerating electrode tube LA#1 stays at ground potential for 100 nanoseconds, a pulsed ion beam including about $2.7\times10^8$ charged particles 2 (hexavalent carbon ions) will be obtained. In order to produce an ion beam including more charged particles 2 to increase the amount of radiation, it is sufficient to place the accelerating electrode tube LA#1 at ground potential for a time period longer than 100 nanoseconds. Conversely, in order to decrease the amount of radiation per pulsed ion beam, it is sufficient to place the accelerating electrode tube LA#1 at ground potential for a time period shorter than 100 nanoseconds. Therefore, the linear-trajectory charged particle accelerator shown in FIG. 1 can arbitrarily program the amount of radiation per pulsed ion beam.

The pulsed ion beam is injected into the accelerating electrode tube LA#1 while being accelerated by a difference in electric potential between the ion source 1 and the accelerating electrode tube LA#1. When the leading edge of the pulsed ion beam substantially reaches the center of the accelerating electrode tube LA#1, the controller 8 outputs "1" to the switching circuit S#1, thus switching the electric potential of the accelerating electrode tube LA#1 to 20 kV. When the pulsed ion beam is emitted from the accelerating electrode tube LA#1, it is accelerated for the second time by a difference in electric potential between the accelerating electrode tubes LA#1 and LA#2.

Thereafter, when the leading edge of the pulsed ion beam substantially reaches the center of the accelerating electrode tube LA#2, the controller 8 switches the electric potential of the accelerating electrode tube LA#2 to 20 kV. When the pulsed ion beam is emitted from the accelerating electrode tube LA#2, it is accelerated again, this time by a difference in electric potential between the accelerating electrode tubes LA#2 and LA#3. The controller 8 increases the accelerating energy of the pulsed ion beam, namely the charged particle 2, by repeating the above sequence control for applied voltage with respect to the accelerating electrode tubes LA#2 to LA#28.

The speed of the pulsed ion beam increases each time the pulsed ion beam passes through an accelerating electrode tube. Hence, considering a delay in response of a switching circuit S#n, in order to reliably switch the electric potential when the pulsed ion beam is substantially at the center of an accelerating electrode tube LA#n, it is necessary to increase the lengths of subsequent accelerating electrode tubes. In Embodiment 1 of the present invention, the accelerating electrode tubes have the lengths presented in Table 1. Table 1 also presents reference values of the energy and pulse width of the pulsed ion beam injected into the accelerating electrode tubes. The pulsed ion beam is accelerated by a difference in electric potential between the accelerating electrode tube LA#28 and the dummy electrode tube 7 at the end, thus obtaining an accelerating energy of 2 MeV/u in total. Note that in an application where beam convergence is required, such as the case of acceleration of a large-current pulsed ion beam, quadrupole electrostatic lenses or other beam convergence circuits may be disposed in the accelerating electrode tubes or on an ion beam transport path. Specific optical designs, i.e. the locations and properties of the beam convergence circuits, will be adjusted on a case-by-case basis in accordance with the intensity of the ion beam and a required beam diameter.

TABLE 1

| Number of Linear Accelerating Electrode Tube | Length of Electrode Tube (mm) | Injected Beam Pulse Energy (KeV/U) | Injected Beam Pulse Pulse Width*1 (Nanoseconds) |
|---|---|---|---|
| LA#1 | 600 | 10 | 100 |
| LA#2 | 600 | 20 | 71 |
| LA#3 | 600 | 30 | 58 |
| LA#4 | 600 | 40 | 50 |
| LA#5 | 650 | 50 | 45 |
| LA#6 | 700 | 60 | 41 |
| LA#7 | 750 | 70 | 38 |
| LA#8 | 800 | 80 | 35 |
| LA#9 | 850 | 90 | 33 |
| LA#10 | 900 | 100 | 32 |
| LA#11 | 1000 | 200 | 22 |
| LA#12 | 1200 | 300 | 18 |
| LA#13 | 1350 | 400 | 16 |
| LA#14 | 1500 | 500 | 14 |
| LA#15 | 1650 | 600 | 13 |
| LA#16 | 1750 | 700 | 12 |
| LA#17 | 1900 | 800 | 11 |
| LA#18 | 2000 | 900 | 11 |
| LA#19 | 2100 | 1000 | 10 |
| LA#20 | 2200 | 1100 | 10 |
| LA#21 | 2300 | 1200 | 9 |
| LA#22 | 2400 | 1300 | 9 |
| LA#23 | 2500 | 1400 | 8 |
| LA#24 | 2600 | 1500 | 8 |
| LA#25 | 2700 | 1600 | 8 |
| LA#26 | 2750 | 1700 | 8 |
| LA#27 | 2800 | 1800 | 7 |
| LA#28 | 2900 | 1900 | 7 |

*1Values obtained in the case where a time period for which an ion is extracted from the ion source is 100 nanoseconds.

Figure 2:
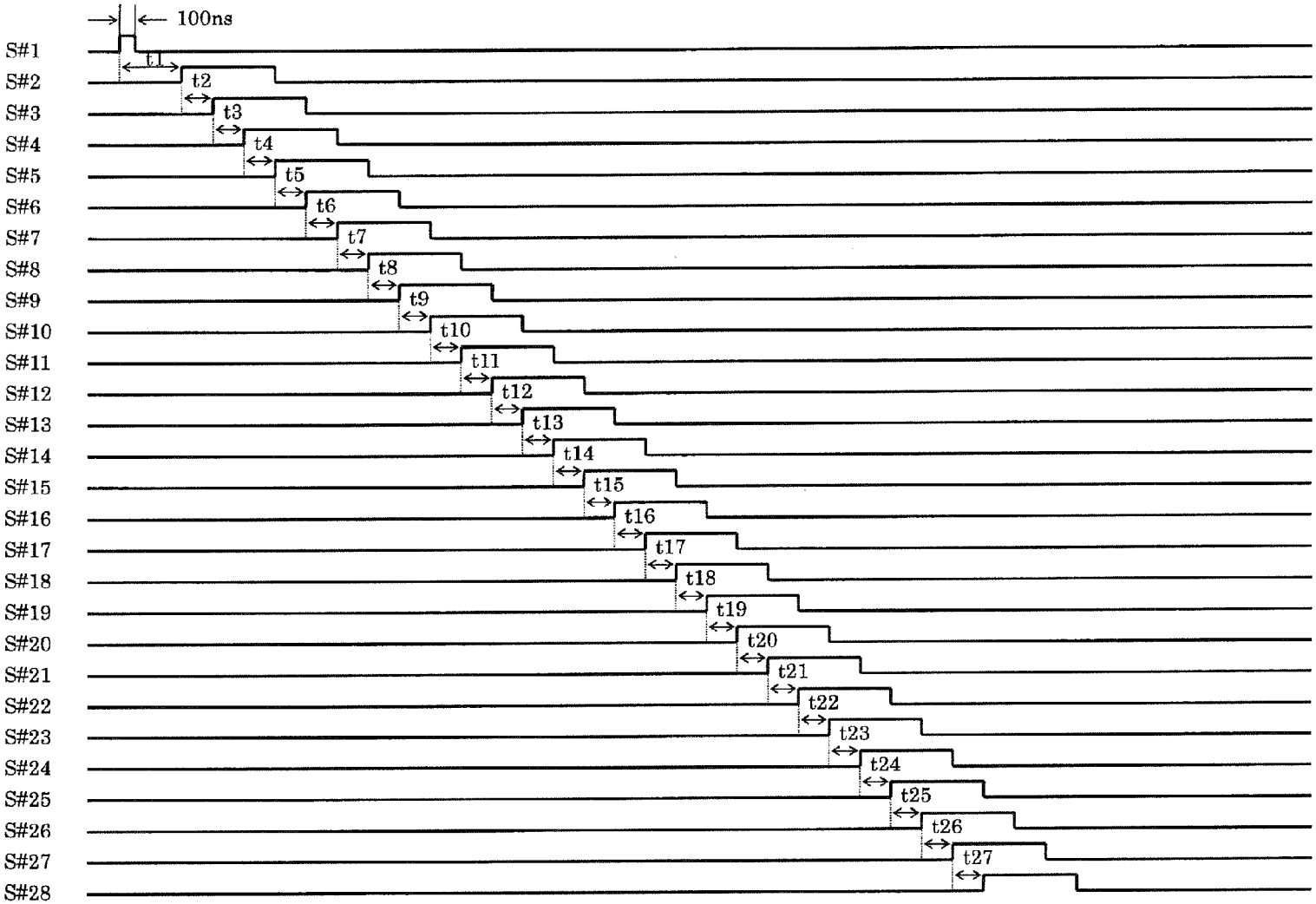
FIG. 2 is a timing chart showing timings of operations of a controller pertaining to Embodiment 1.

FIG. 2 shows one example of a timing chart of sequence control that is carried out by the controller 8 to accelerate the charged particle 2 emitted from the ion source 1 to an energy of 2 MeV/u. The timing chart shown in FIG. 2 is for the case where the controller 8 extracts the beam for 100 nanoseconds at first. The controller 8 turns on/off the switching circuits S#1 to S#28 in pulses by performing predetermined timed operations. In Embodiment 1, the distance between any two neighboring accelerating electrode tubes is 5 cm, in which case t1 to t27 shown in FIG. 2 have values presented in Table 2. Note that in the example of FIG. 2, a time period in which S#2 to S#28 stay in the on state is fixed to 1 microsecond.

TABLE 2

| | Time Period (Nanoseconds) |
|---|---|
| t1 | 620 |
| t2 | 300 |
| t3 | 250 |
| t4 | 230 |
| t5 | 220 |
| t6 | 220 |
| t7 | 220 |
| t8 | 220 |
| t9 | 190 |
| t10 | 170 |
| t11 | 160 |
| t12 | 160 |
| t13 | 160 |
| t14 | 160 |
| t15 | 160 |
| t16 | 160 |
| t17 | 160 |
| t18 | 160 |
| t19 | 160 |
| t20 | 160 |
| t21 | 160 |
| t22 | 160 |

TABLE 2-continued

| | Time Period (Nanoseconds) |
|---|---|
| t23 | 160 |
| t24 | 160 |
| t25 | 160 |
| t26 | 150 |
| t27 | 150 |

When the pulsed ion beam is emitted from one accelerating electrode tube and injected into a subsequent accelerating electrode tube, it is accelerated by a difference in electric potential between the two accelerating electrode tubes. At this time, an accelerating current flows through the 20-kV direct current power supply 3 or the 200-kV direct current power supply 5. The ammeters 4 and 6 measure this accelerating current and notify the controller 8 of the measured accelerating current. Based on the value measured by the ammeters 4 and 6, the controller 8 learns a timing when the pulsed ion beam is accelerated, namely a timing when the pulsed ion beam passes between the two accelerating electrode tubes. The controller 8 calculates the actual accelerating energy of the pulsed ion beam from this timing data, and when there is a large deviation between the calculated value and a scheduled value, it judges that some sort of abnormality has occurred in the device and executes, for example, processing of warning an operator to that effect.

The values of time periods presented in Table 2 have been calculated under the precondition that the direct current power supplies 3 and 5 output a complete rated voltage. If the voltage output from the direct current power supply 3 or 5 is disturbed, e.g. if its voltage value fluctuates due to a sudden change in the primary power supply voltage and the like, then the values of time periods presented in Table 2 need to be corrected depending on the situation. For this reason, the controller 8 executes processing for correcting times to start applying voltage to the accelerating electrode tubes based on values measured by the ammeters 4 and 6.

The following describes processing for correcting a timing to apply voltage to an accelerating electrode tube LA#n (n=2, 3, . . . , 28) in more detail. Assume that an ion beam is in a preceding accelerating electrode tube LA#n−1 and proceeding to the subsequent accelerating electrode tube LA#n at a speed of $v_{n-1}$. At this time, the accelerating voltage is applied to LA#n−1. Also assume that when the ion beam passes through a gap between LA#n−1 and LA#n, it is accelerated by a difference in electric potential between the two accelerating electrode tubes, and when it arrives at LA#n, the speed thereof reaches $v_n$. During the accelerating operation, an accelerating current flows through a direct current power supply. As the gap between the accelerating electrode tubes can be approximated to a uniform electric field, a time period $T_{ai}(n-1)$ in which the accelerating current flows through LA#n−1 can be obtained by Expression 1.

[Math 1]

$$T_{ai}(n-1) \approx 2 \times \frac{d + W_{ib}}{v_n + v_{n-1}} \quad \text{(Expression 1)}$$

Here, d denotes the length of the gap between the accelerating electrode tubes, and $w_{ib}$ denotes the pulse length of the ion beam. As $v_n$ is a known value, the speed $v_n$ of the accelerated ion beam can be obtained from Expression 1 by measuring $T_{ai}(n-1)$.

In the present embodiment, as a voltage of 20 kV is extracted from the ion source 1, the ion beam is accelerated to $1.39\times10^6$ msec when it arrives at LA#1. Furthermore, as a time period for which the ion beam is extracted is 100 ns, the pulse width of the ion beam is 0.139 m. Therefore, $v_1\approx1.39\times10^6$ m/sec, $w_{ib}\approx10^9$ ns=0.139 m, and an electrode gap d is 5 cm, that is to say, d=0.05 m. The value of $T_{ai}(1)$ can be obtained by measuring the accelerating current of LA#1, and $v_2$, namely the speed of the ion beam in LA#2, can be calculated from the relationship of Expression 1. As the value of the length of the accelerating electrode tube LA#2 is known, a timing when the ion beam is at a central portion of LA#2, namely the best timing to output "1" to the switching circuit S#2, can be obtained from the value of $v_2$.

While the device is performing a rated operation, the ion beam is subjected to 20-kV acceleration in a gap between LA#1 and LA#2, and therefore $v_2\approx1.96\times10^6$ m/sec. In this case, the best value for t1 shown in FIG. 2 is 620 ns as presented in Table 2.

When there is a deviation from a rated value during the accelerating operation due to disturbances, such as fluctuations in the power supply voltage, the value of $v_2$ calculated from the measured value $T_{ai}(1)$ deviates from $1.96\times10^6$ m/sec. In this case, the controller 8 re-sets t1 based on $v_2$ calculated from the measured value and continues the timing control using the re-set t1. The controller 8 corrects and optimizes a timing to apply voltage to each accelerating electrode tube using the above recursive procedure.

By measuring an accelerating current flowing through an accelerating electrode tube in the above-described manner, it is possible to control a timing to apply the accelerating voltage to a subsequent accelerating electrode tube more accurately, and to detect occurrence of any device failure when the flow of the accelerating current cannot be confirmed within a predetermined time period. Furthermore, as a timing of travel of an accelerated charged particle can be measured based on an accelerating current flowing through an accelerating electrode tube, it is possible to perform timing control that is resistant to disturbances such as fluctuations in the power supply, and thus to provide a high-quality accelerator.

Figure 3:
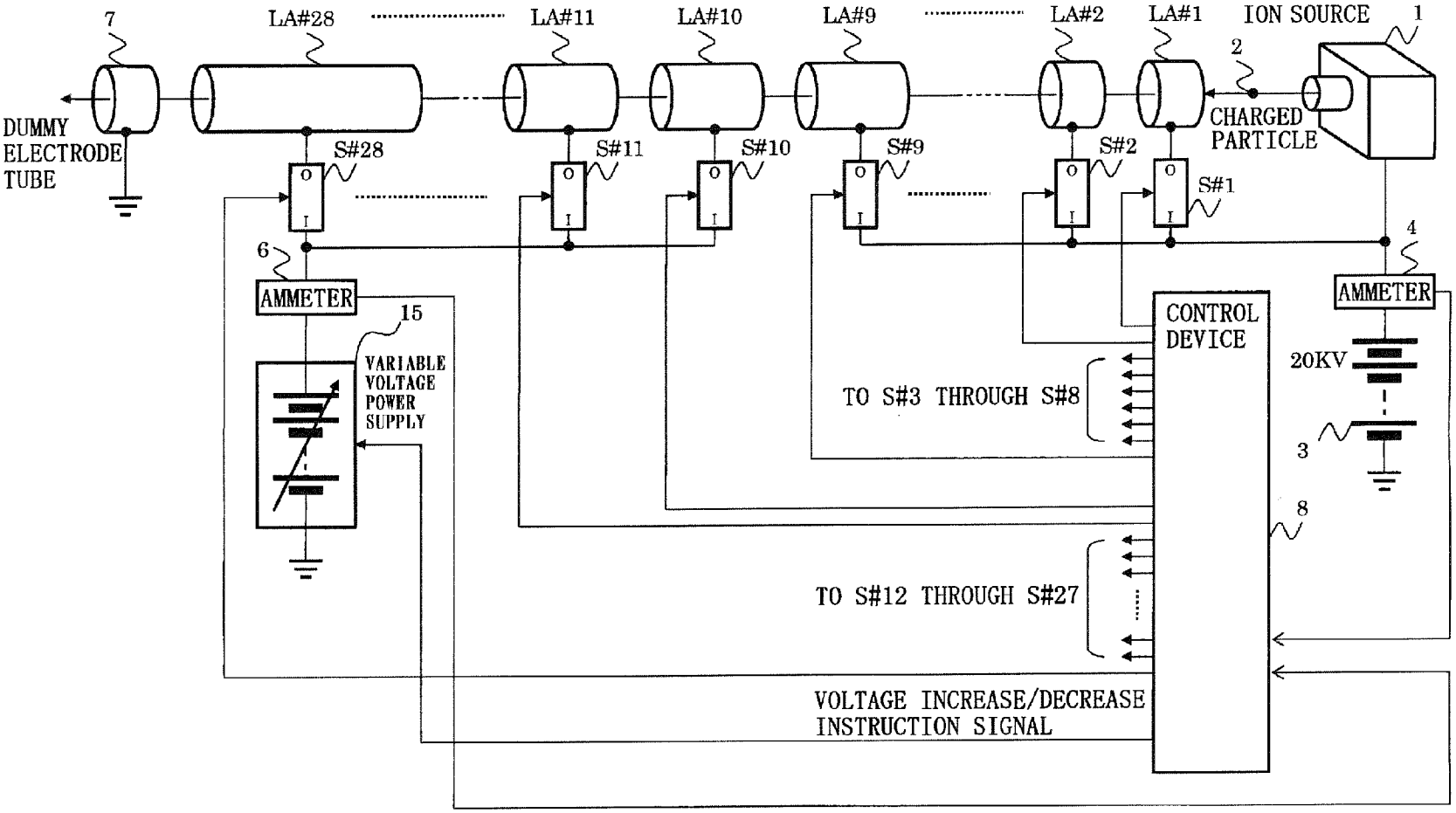
FIG. 3 shows a configuration of another charged particle accelerator with a linear trajectory.

Although a power supply of a fixed voltage is used as a direct current power supply in FIG. 1, a direct current power supply of a variable voltage may instead be used. FIG. 3 shows an embodiment of this case. In FIG. 3, the 200-kV direct current power supply 5 shown in FIG. 1 is replaced by a variable voltage power supply 15 that can increase and decrease its voltage under control of the controller 8. In the example shown in FIG. 3, the accelerating voltage can be selected from various voltage values, and therefore a linear trajectory accelerator capable of programming any accelerating energy per pulsed ion beam can be realized. Furthermore, when there is a deviation between the actual accelerating energy of the pulsed ion beam measured by the ammeter 6 and a scheduled value, an adjustment operation can be performed to increase or decrease the accelerating voltage from that point so as to revert it to the scheduled value. By thus providing the controller with a function of increasing and decreasing the accelerating voltage, the accelerating energy of a charged particle can be arbitrarily changed. With such a controller capable of increasing and decreasing the accelerating voltage, it is possible to provide a highly flexible accelerator that can program any accelerating energy.

As set forth above, in the present embodiment, when a charged particle extracted from an ion source or an electron source is injected into the first accelerating electrode tube, the controller applies the accelerating voltage to the accelerating electrode tube at a timing when the charged particle has completely entered the accelerating electrode tube. As a subsequent accelerating electrode tube is maintained at ground potential (0 V) at first, the charged particle emitted from the first accelerating electrode tube is accelerated by a difference in electric potential between the first and second accelerating electrode tubes. Thereafter, the controller applies the accelerating voltage to the second accelerating electrode tube at a timing when the charged particle has entered the second accelerating electrode tube. By repeatedly performing such timing control on n accelerating electrode tubes arranged in a linear fashion, the accelerating energy of the charged particle can be increased. Note that the electric potential of any accelerating electrode tube that comes after the first accelerating electrode tube is reset to ground potential after the charged particle has entered a subsequent accelerating electrode tube. With the above configuration, accelerating electric fields can be generated through distributed control of voltage applied to each accelerating electrode tube. In this way, a radio-frequency power generation circuit that has been conventionally required becomes no longer necessary, and an inexpensive and highly reliable accelerator can be provided.

Embodiment 2

Figure 4A:
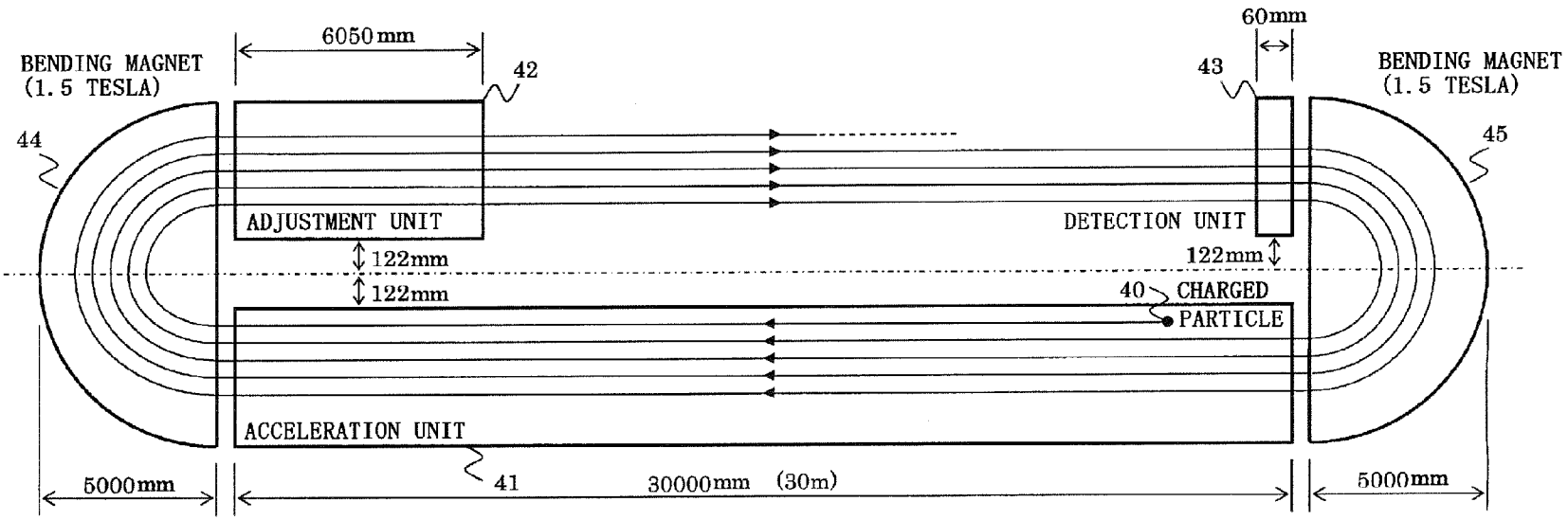
FIG. 4A is a plan view showing a configuration of a charged particle accelerator with a spiral trajectory pertaining to Embodiment 2.
Figure 4B:
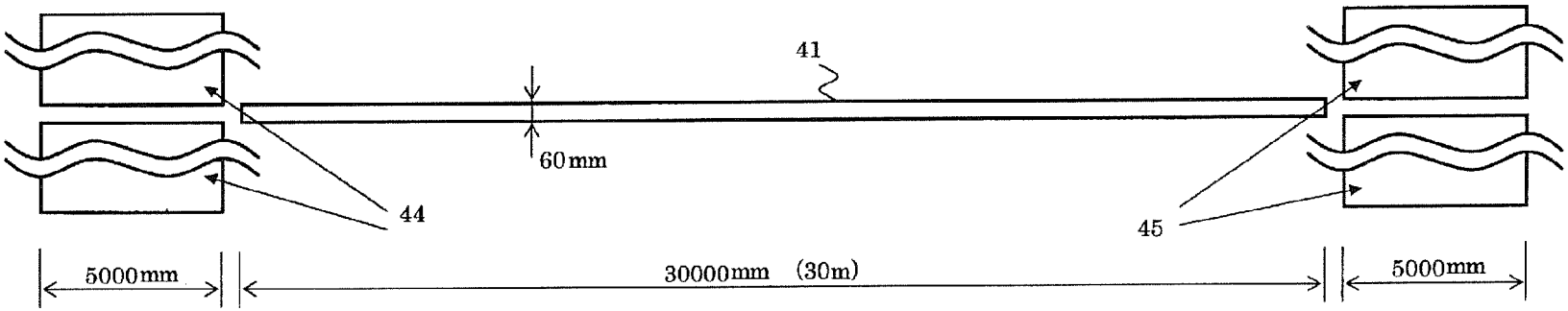
FIG. 4B is a side view showing a configuration of the charged particle accelerator with the spiral trajectory pertaining to Embodiment 2.

FIGS. 4A and 4B are respectively a plan view and a side view showing a configuration of a charged particle accelerator with a spiral trajectory pertaining to Embodiment 2 of the present invention. In FIG. 4A, 40 denotes a charged particle, 41 denotes an acceleration unit, 42 denotes an adjustment unit, 43 denotes a detection unit, and 44 and 45 denote bending magnets.

Detailed configurations of the acceleration unit 41, the adjustment unit 42 and the detection unit 43 of FIG. 4A are shown in FIGS. 5A to 5C, FIGS. 6A to 6C and FIGS. 7A to 7C respectively. The acceleration unit 41 is constituted by an assembly of modules called accelerating cells, with each module having a width of 60 mm, a height of 30 mm, and a depth of 30000 mm (30 m). Similarly, the adjustment unit 42 is constituted by an assembly of modules called adjustment cells, with each module having a width of 60 mm, a height of 30 mm, and a depth of 6050 mm. The detection unit 43 is constituted by an assembly of modules called detection cells, with each module having a width of 60 mm, a height of 30 mm, and a depth of 60 mm.

Figure 5A:
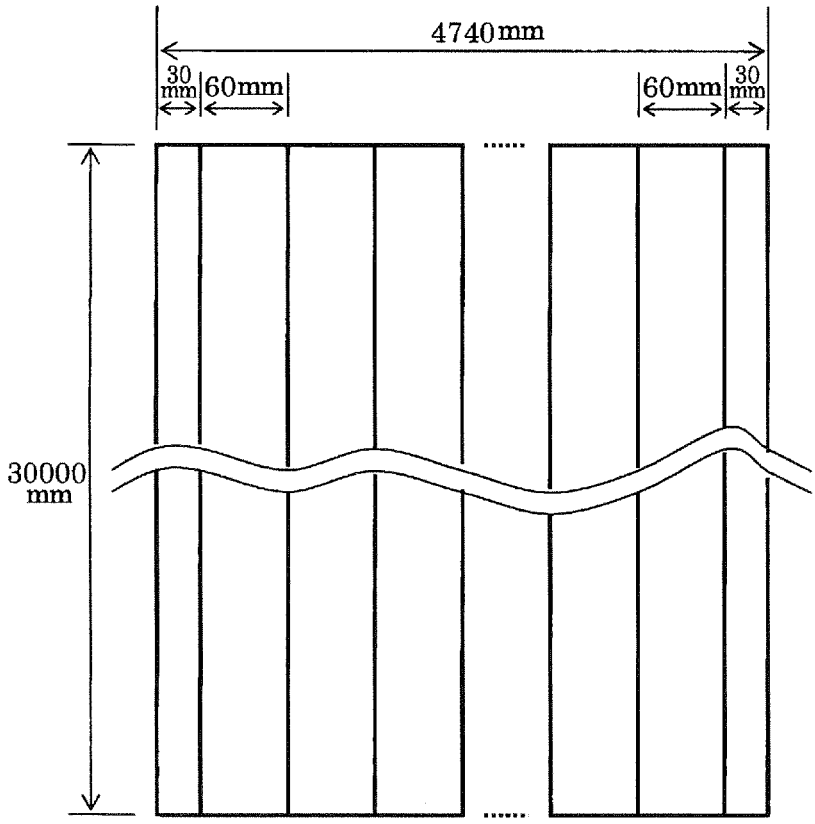
FIG. 5A is a plan view showing a configuration of an acceleration unit pertaining to Embodiment 2.
Figure 5B:
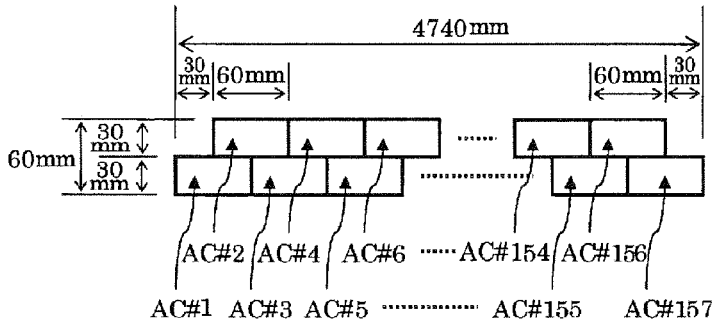
FIG. 5B is a front view showing a configuration of the acceleration unit pertaining to Embodiment 2.
Figure 5C:
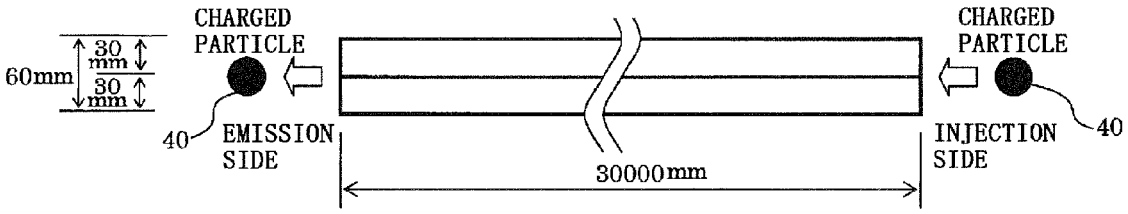
FIG. 5C is a side view showing a configuration of the acceleration unit pertaining to Embodiment 2.
Figure 6A:
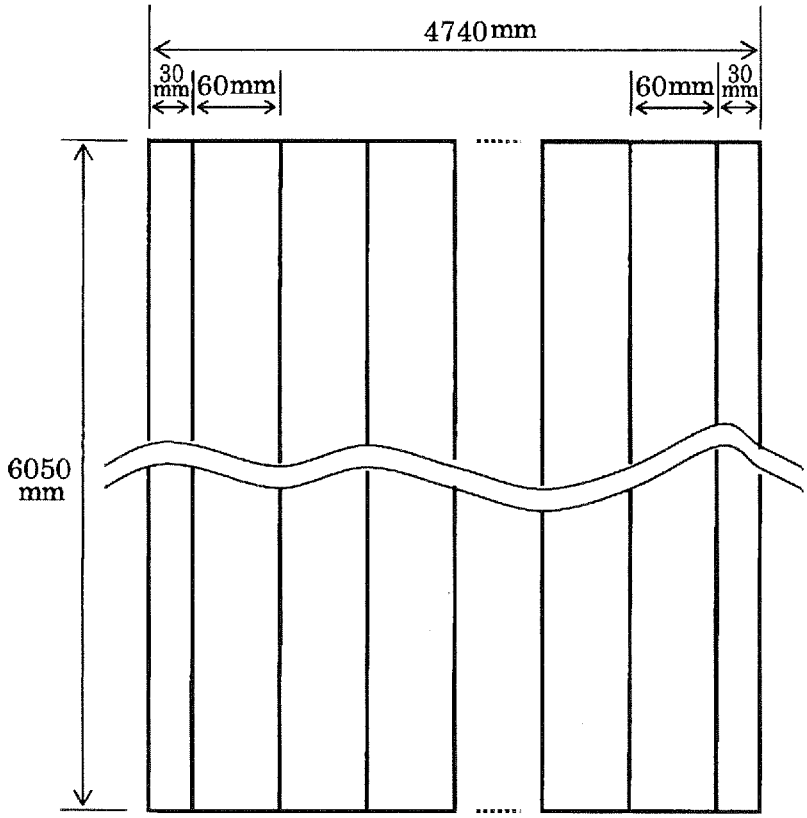
FIG. 6A is a plan view showing a configuration of an adjustment unit pertaining to Embodiment 2.
Figure 6B:
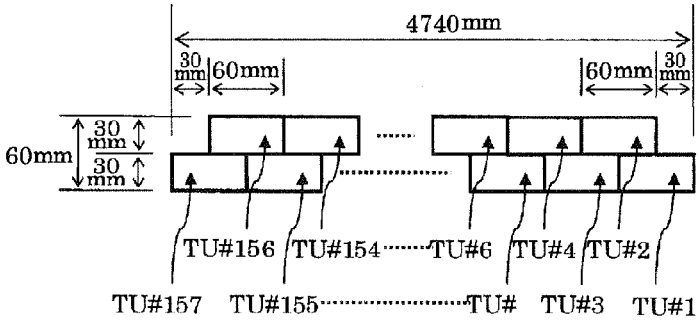
FIG. 6B is a front view showing a configuration of the adjustment unit pertaining to Embodiment 2.
Figure 6C:
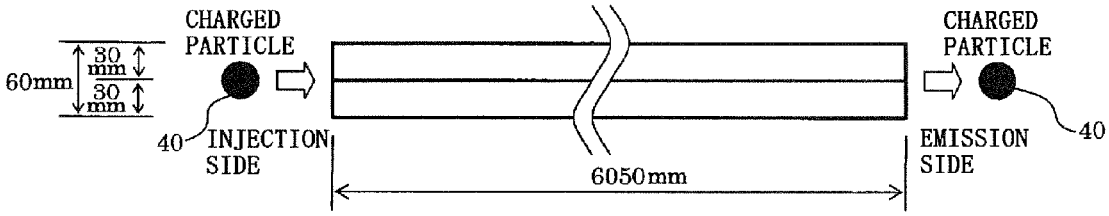
FIG. 6C is a side view showing a configuration of the adjustment unit pertaining to Embodiment 2.
Figure 7A:
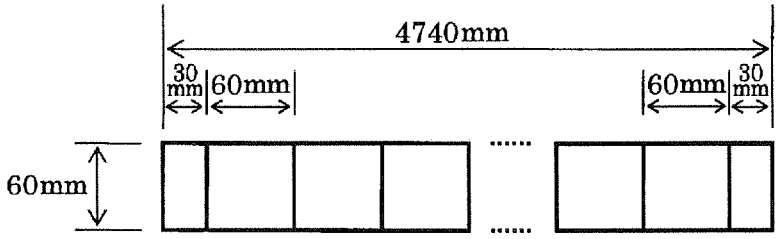
FIG. 7A is a plan view showing a configuration of a detection unit pertaining to Embodiment 2.
Figure 7B:
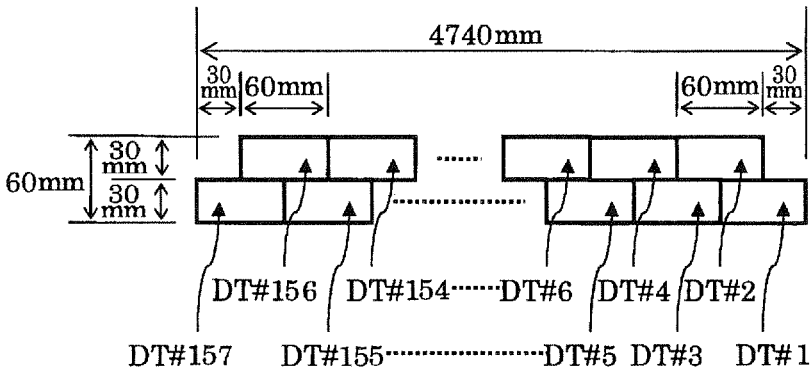
FIG. 7B is a front view showing a configuration of the detection unit pertaining to Embodiment 2.
Figure 7C:
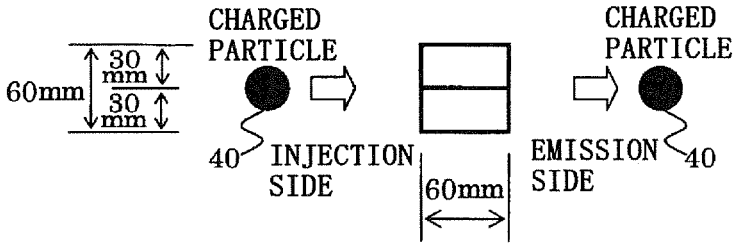
FIG. 7C is a side view showing a configuration of the detection unit pertaining to Embodiment 2.
Figure 8A:
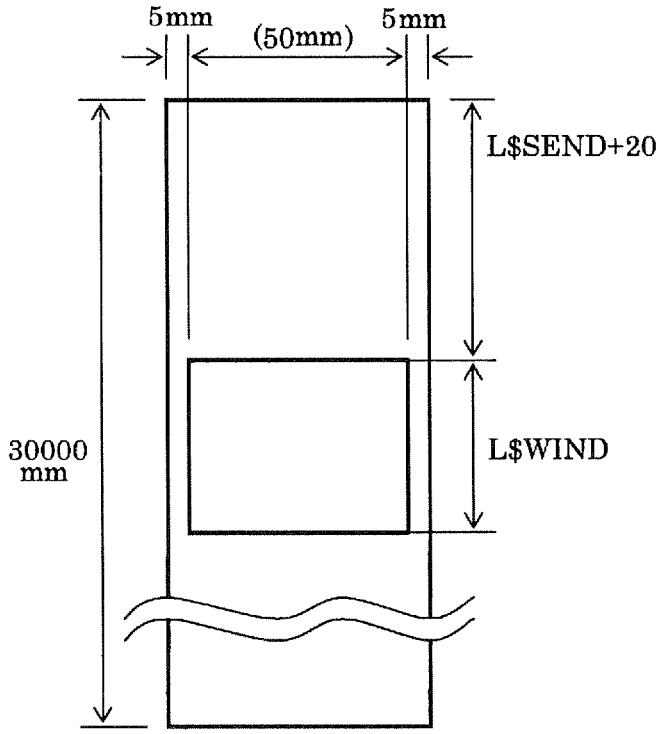
FIG. 8A is a plan view showing a configuration of an odd-numbered accelerating cell.
Figure 8B:
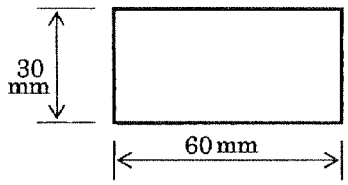
FIG. 8B is a front view showing a configuration of an odd-numbered accelerating cell.
Figure 8C:
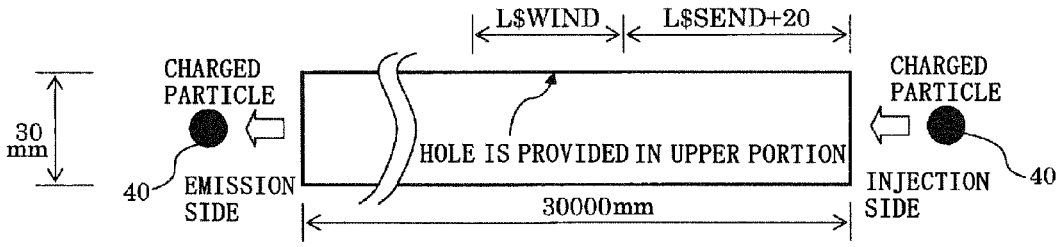
FIG. 8C is a side view showing a configuration of an odd-numbered accelerating cell.
Figure 9A:
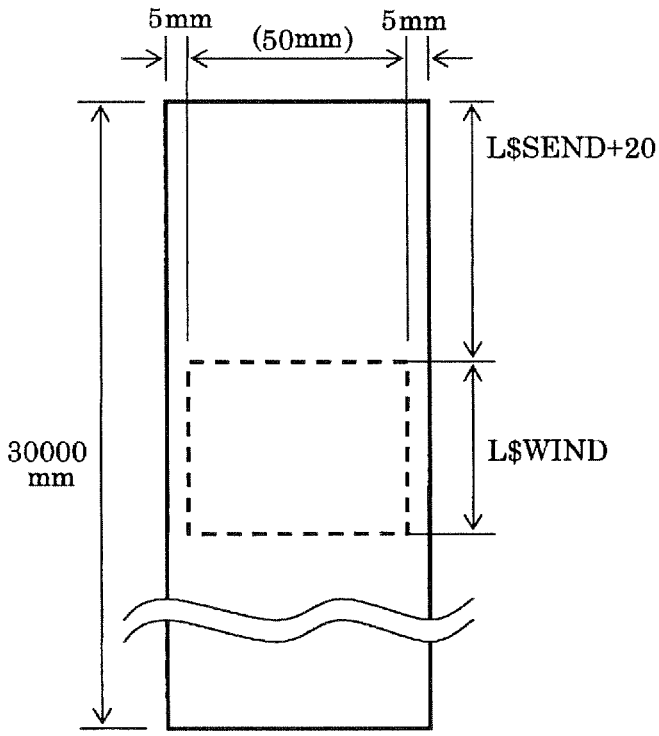
FIG. 9A is a plan view showing a configuration of an even-numbered accelerating cell.
Figure 9B:
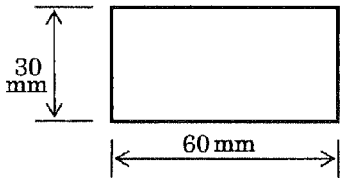
FIG. 9B is a front view showing a configuration of an even-numbered accelerating cell.
Figure 9C:
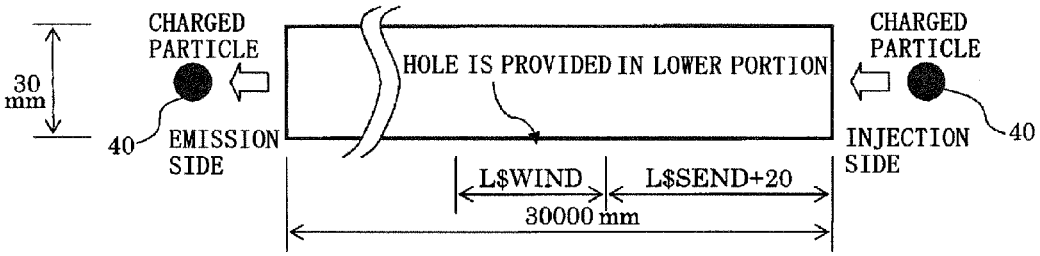
FIG. 9C is a side view showing a configuration of an even-numbered accelerating cell.
Figure 10A:
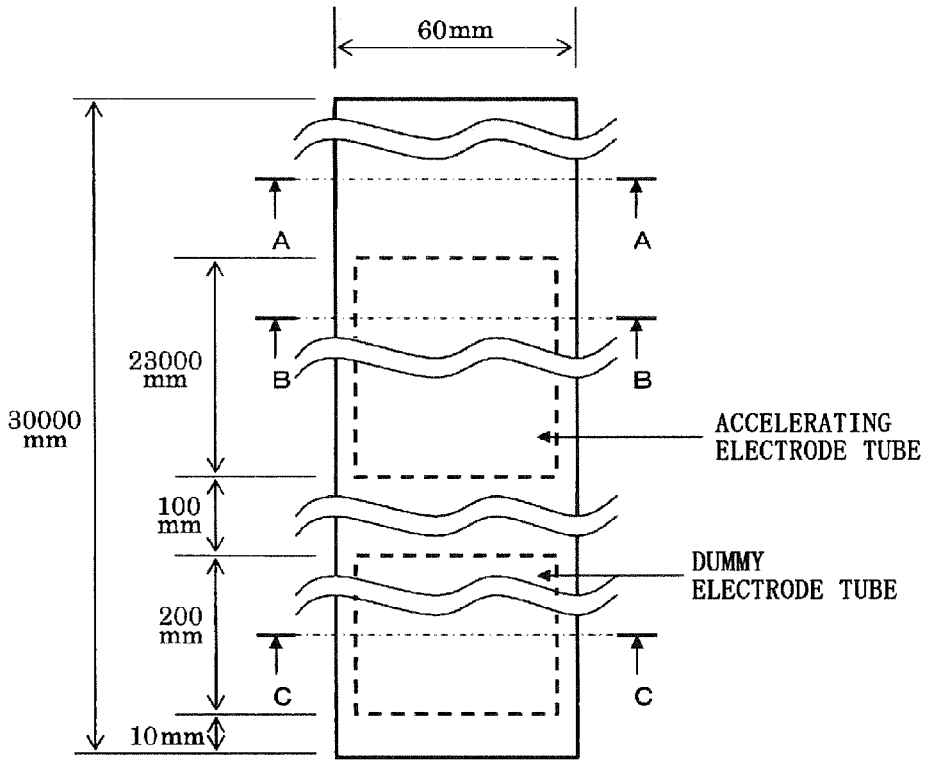
FIG. 10A is a plan view showing a configuration of an emission side of an accelerating cell.
Figure 10B:
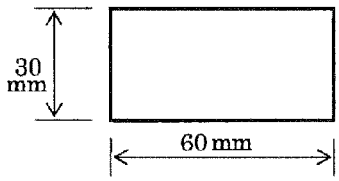
FIG. 10B is a front view showing a configuration of an emission side of an accelerating cell.
Figure 10C:
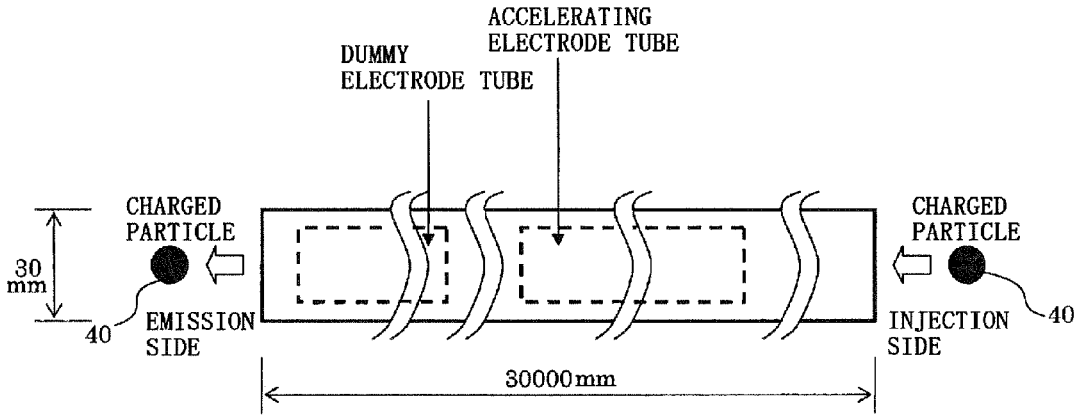
FIG. 10C is a side view showing a configuration of an emission side of an accelerating cell.
Figure 10D:
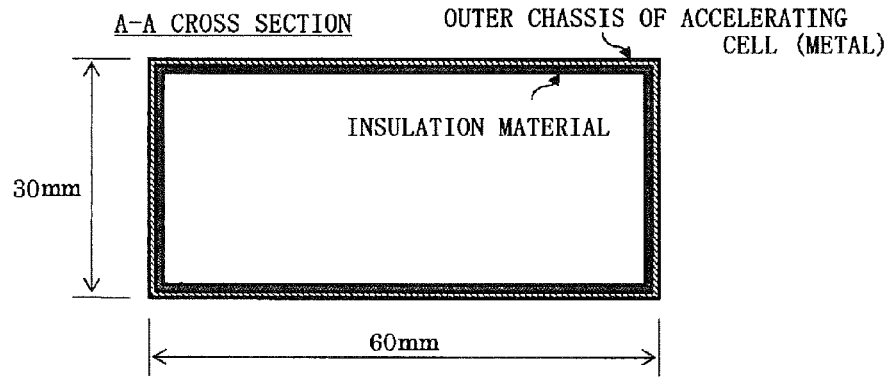
FIG. 10D is a cross-sectional view of the accelerating cell shown in FIG. 10A.
Figure 10E:
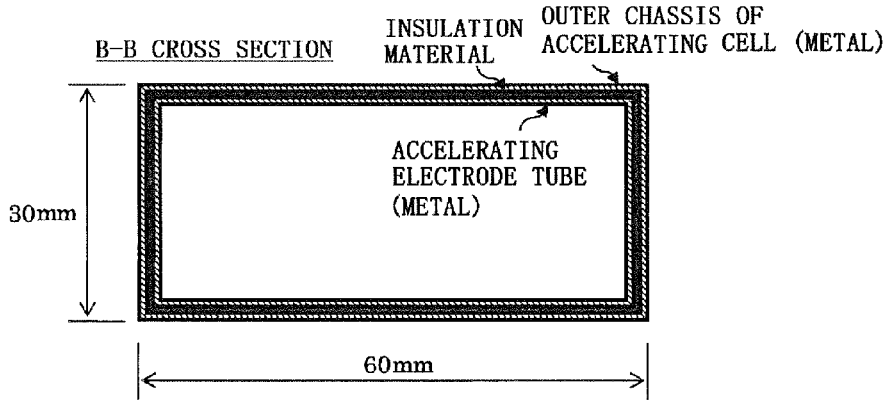
FIG. 10E is a cross-sectional view of the accelerating cell shown in FIG. 10A.
Figure 10F:
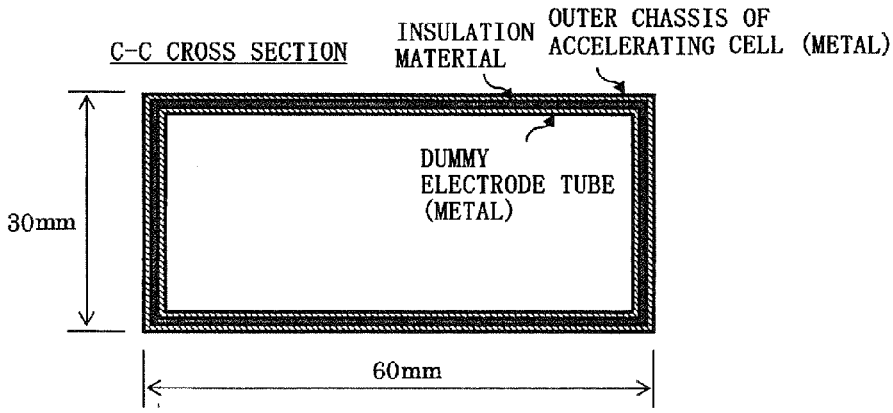
FIG. 10F is a cross-sectional view of the accelerating cell shown in FIG. 10A.
Figure 11A:
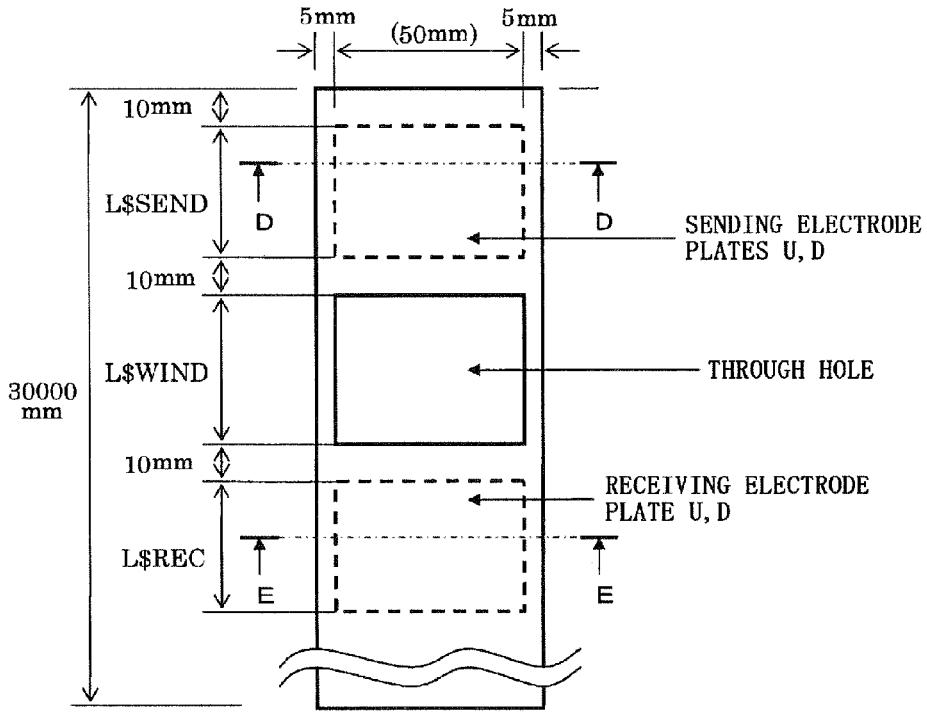
FIG. 11A is a plan view showing a configuration of an injection side of an odd-numbered accelerating cell.
Figure 11B:
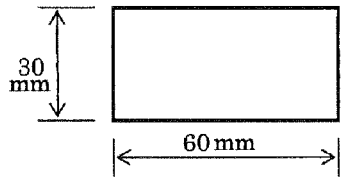
FIG. 11B is a front view showing a configuration of an injection side of an odd-numbered accelerating cell.
Figure 11C:
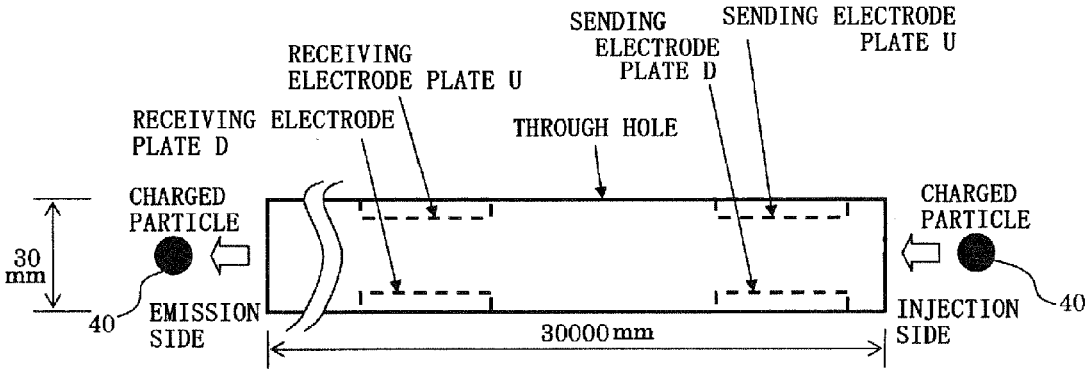
FIG. 11C is a side view showing a configuration of an injection side of an odd-numbered accelerating cell.
Figure 11D:
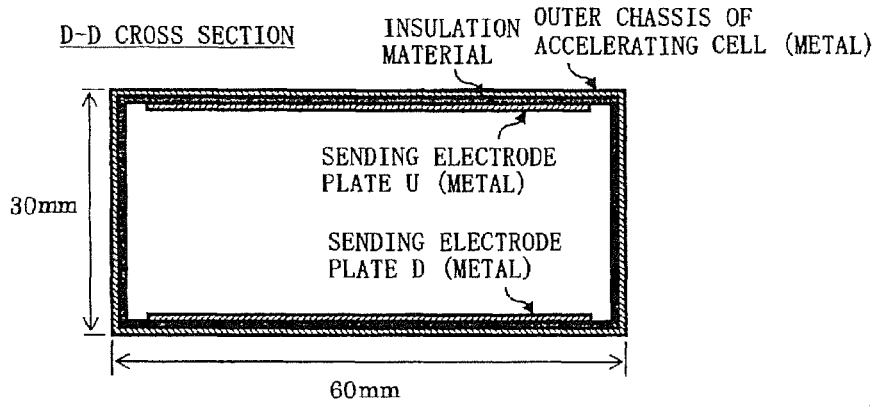
FIG. 11D is a cross-sectional view of the odd-numbered accelerating cell shown in FIG. 11A.
Figure 11E:
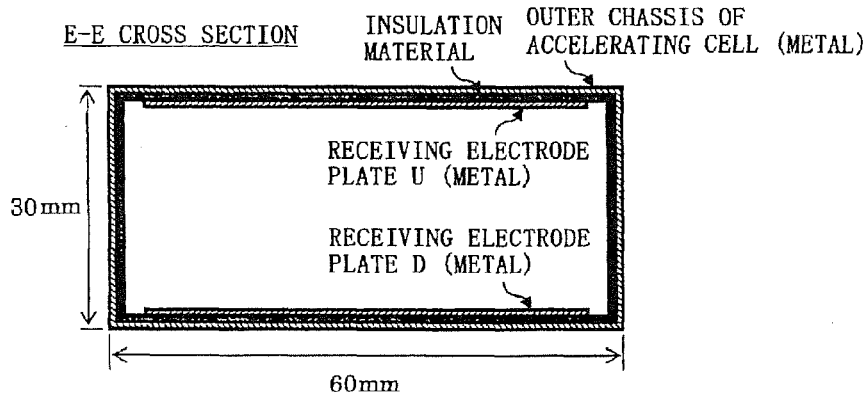
FIG. 11E is a cross-sectional view of the odd-numbered accelerating cell shown in FIG. 11A.
Figure 12A:
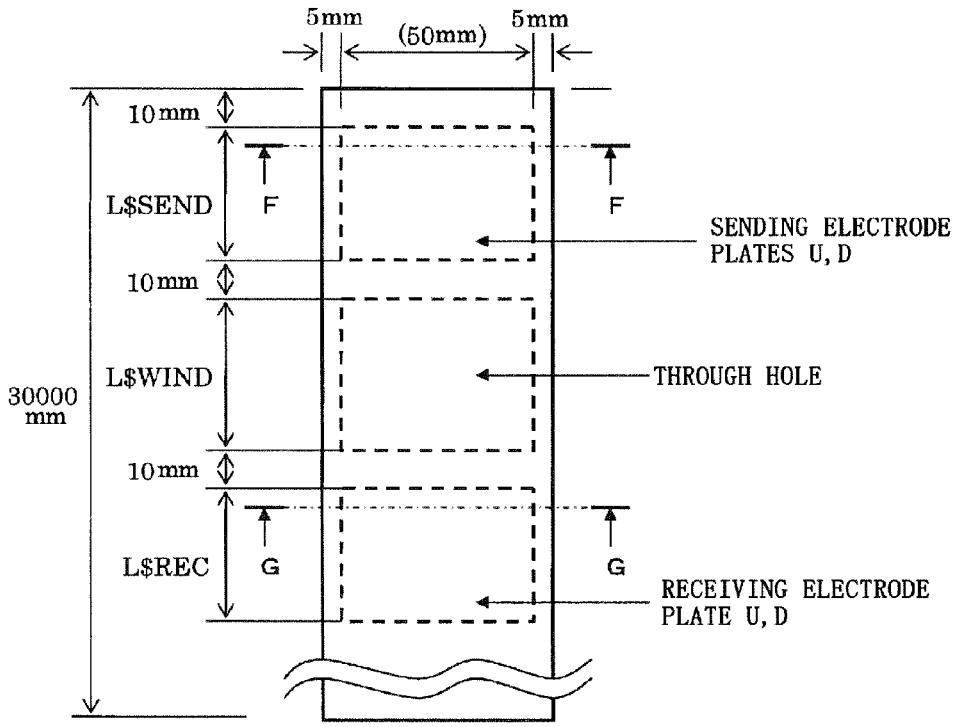
FIG. 12A is a plan view showing a configuration of an injection side of an even-numbered accelerating cell.
Figure 12B:
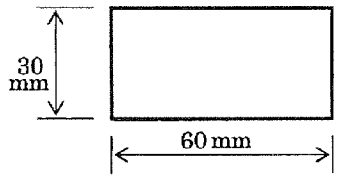
FIG. 12B is a front view showing a configuration of an injection side of an even-numbered accelerating cell.
Figure 12C:
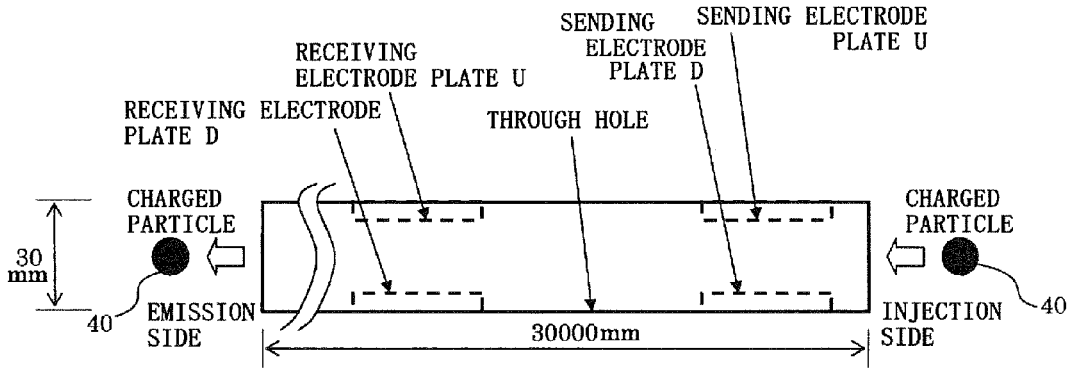
FIG. 12C is a side view showing a configuration of an injection side of an even-numbered accelerating cell.
Figure 12D:
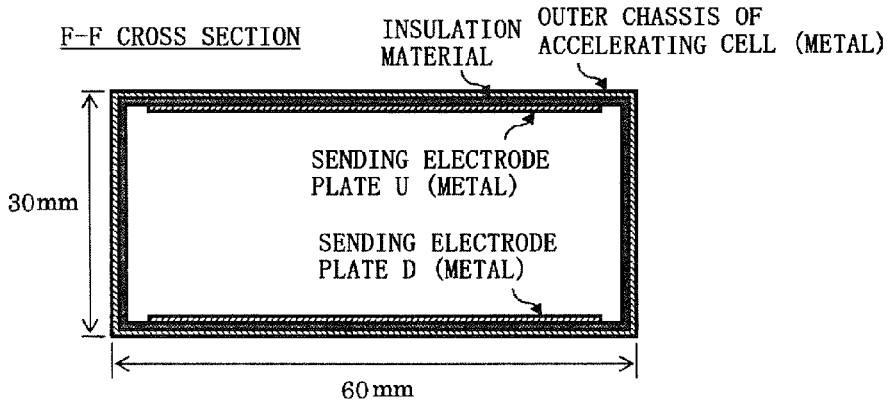
FIG. 12D is a cross-sectional view of the even-numbered accelerating cell shown in FIG. 12A.
Figure 12E:
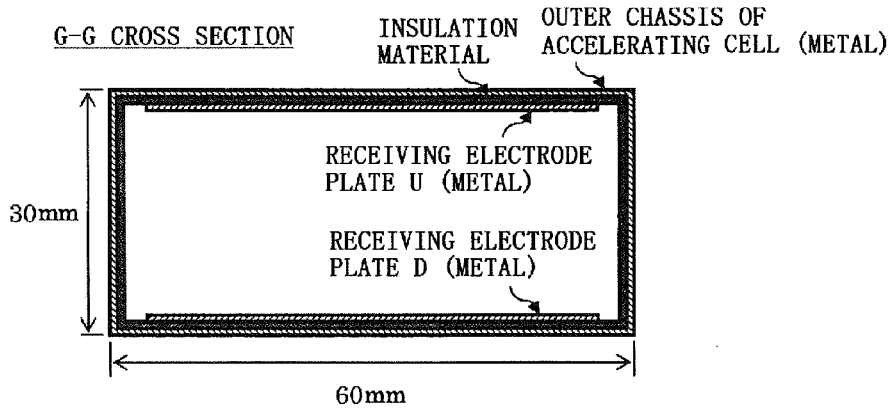
FIG. 12E is a cross-sectional view of the even-numbered accelerating cell shown in FIG. 12A.
Figure 13A:
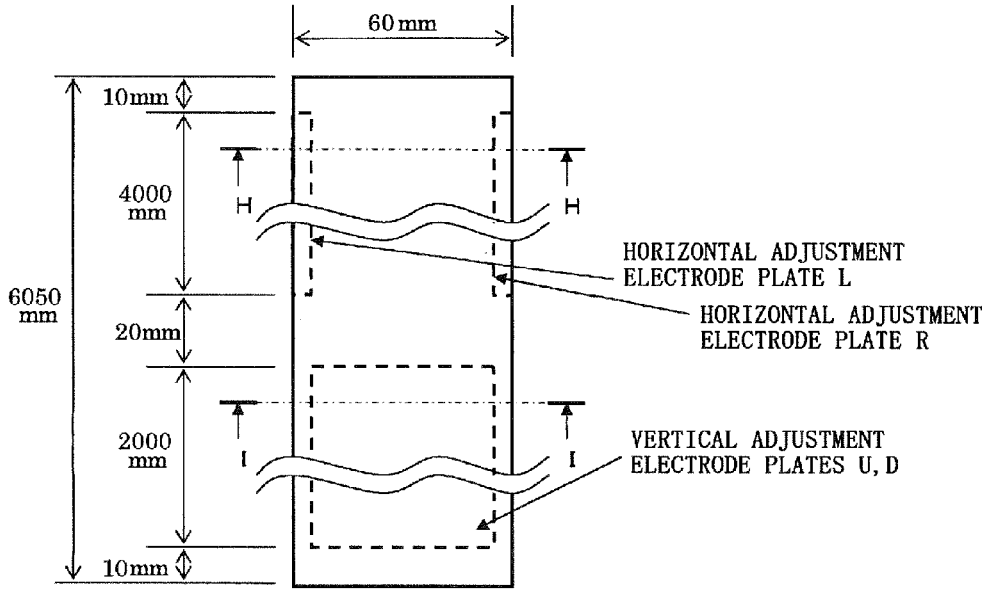
FIG. 13A is a plan view showing a configuration of an adjustment cell.
Figure 13B:
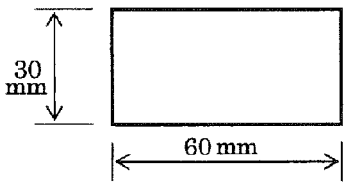
FIG. 13B is a front view showing a configuration of an adjustment cell.
Figure 13C:
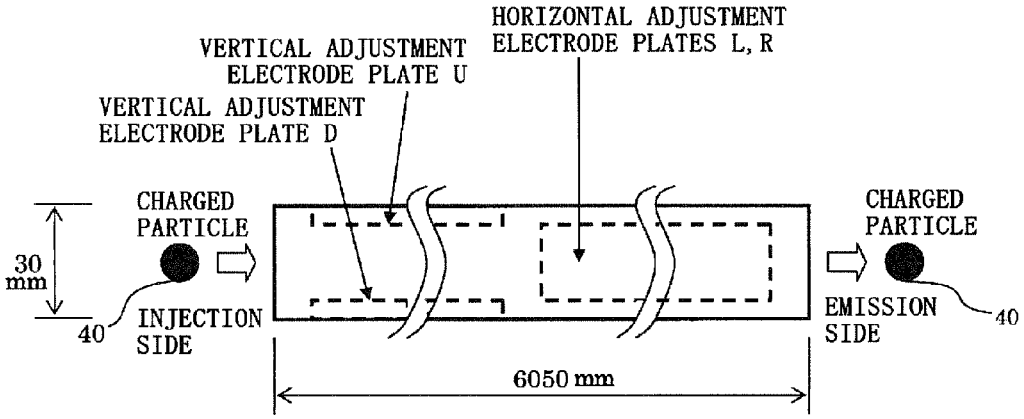
FIG. 13C is a side view showing a configuration of an adjustment cell.
Figure 13D:
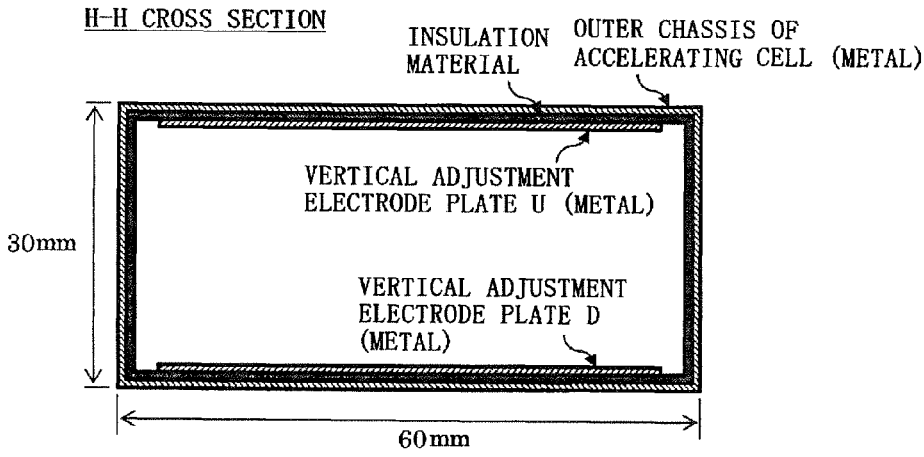
FIG. 13D is a cross-sectional view of the adjustment cell shown in FIG. 13A.
Figure 13E:
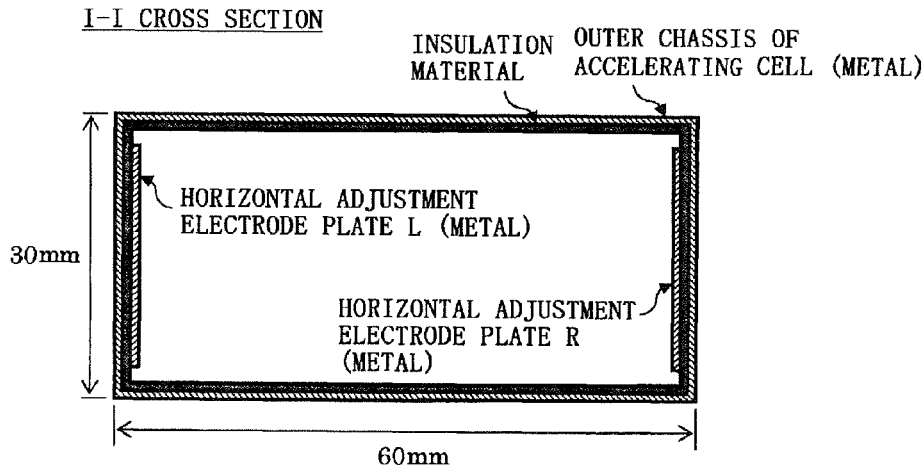
FIG. 13E is a cross-sectional view of the adjustment cell shown in FIG. 13A.

In the present case, the acceleration unit 41 is constituted by 157 accelerating cells. Similarly, the adjustment unit 42 is constituted by 157 adjustment cells, and the detection unit 43 is constituted by 157 detection cells. As shown in FIG. 5B, the 157 accelerating cells AC#1 to AC#157 are arranged in two (upper and lower) tiers. Specifically, odd-numbered accelerating cells are arranged in the lower tier, whereas even-numbered accelerating cells are arranged in the upper tier. FIGS. 8A to 8C show a detailed configuration of an odd-numbered accelerating cell. A through hole is provided in the upper portion of the odd-numbered accelerating cell. As presented in Tables 3 to 8, the location and size of the through hole differ for each number. FIGS. 9A to 9C show a detailed configuration of an even-numbered accelerating cell. A through hole is provided in the lower portion of the even-numbered accelerating cell. As presented in Tables 3 to 8, the location and size of the through hole differ for each number.

TABLE 3

| Number of Accelerating Cell | Energy (MeV/U) Injection | Emission | Size (mm) L$REC | L$WIND | L$SEND |
|---|---|---|---|---|---|
| AC#1 | 2.00 | 2.40 | 196 | 69.2 | 215 |
| AC#2 | 2.40 | 2.90 | 215 | 78.0 | 236 |
| AC#3 | 2.90 | 3.50 | 236 | 87.6 | 259 |
| AC#4 | 3.50 | 4.10 | 259 | 96.5 | 281 |
| AC#5 | 4.10 | 4.80 | 281 | 106 | 304 |
| AC#6 | 4.80 | 5.50 | 304 | 115 | 325 |
| AC#7 | 5.50 | 6.30 | 325 | 124 | 347 |
| AC#8 | 6.30 | 7.10 | 347 | 133 | 369 |
| AC#9 | 7.10 | 7.90 | 369 | 141 | 389 |
| AC#10 | 7.90 | 8.80 | 389 | 150 | 410 |
| AC#11 | 8.80 | 9.70 | 410 | 159 | 430 |
| AC#12 | 9.70 | 10.7 | 430 | 168 | 452 |
| AC#13 | 10.7 | 11.7 | 452 | 176 | 472 |
| AC#14 | 11.7 | 12.8 | 472 | 185 | 494 |
| AC#15 | 12.8 | 13.9 | 494 | 193 | 514 |
| AC#16 | 13.9 | 15.1 | 514 | 202 | 535 |
| AC#17 | 15.1 | 16.3 | 535 | 211 | 556 |
| AC#18 | 16.3 | 17.5 | 556 | 219 | 576 |
| AC#19 | 17.5 | 18.8 | 576 | 227 | 596 |
| AC#20 | 18.8 | 20.1 | 596 | 236 | 616 |
| AC#21 | 20.1 | 21.4 | 616 | 244 | 635 |
| AC#22 | 21.4 | 22.8 | 635 | 252 | 655 |
| AC#23 | 22.8 | 24.3 | 655 | 260 | 676 |
| AC#24 | 24.3 | 25.8 | 676 | 269 | 696 |
| AC#25 | 25.8 | 27.3 | 696 | 277 | 715 |
| AC#26 | 27.3 | 28.9 | 715 | 285 | 735 |
| AC#27 | 28.9 | 30.5 | 735 | 293 | 755 |
| AC#28 | 30.5 | 32.2 | 755 | 301 | 775 |
| AC#29 | 32.2 | 33.9 | 775 | 310 | 794 |
| AC#30 | 33.9 | 35.6 | 794 | 317 | 813 |

TABLE 4

| Number of Accelerating Cell | Energy (MeV/U) Injection | Emission | Size (mm) L$REC | L$WIND | L$SEND |
|---|---|---|---|---|---|
| AC#31 | 35.6 | 37.4 | 813 | 326 | 832 |
| AC#32 | 37.4 | 39.2 | 832 | 333 | 852 |
| AC#33 | 39.2 | 41.1 | 852 | 341 | 871 |
| AC#34 | 41.1 | 43.0 | 871 | 349 | 890 |
| AC#35 | 43.0 | 44.9 | 890 | 357 | 909 |
| AC#36 | 44.9 | 46.9 | 909 | 365 | 928 |
| AC#37 | 46.9 | 48.9 | 928 | 373 | 946 |
| AC#38 | 48.9 | 50.9 | 946 | 380 | 964 |
| AC#39 | 50.9 | 52.9 | 964 | 388 | 982 |
| AC#40 | 52.9 | 55.0 | 982 | 395 | 1000 |
| AC#41 | 55.0 | 57.2 | 1000 | 403 | 1019 |
| AC#42 | 57.2 | 59.4 | 1019 | 410 | 1037 |
| AC#43 | 59.4 | 61.6 | 1037 | 418 | 1055 |
| AC#44 | 61.6 | 63.8 | 1055 | 425 | 1072 |
| AC#45 | 63.8 | 66.1 | 1072 | 432 | 1090 |
| AC#46 | 66.1 | 68.4 | 1090 | 440 | 1107 |
| AC#47 | 68.4 | 70.7 | 1107 | 447 | 1124 |
| AC#48 | 70.7 | 73.0 | 1124 | 454 | 1141 |
| AC#49 | 73.0 | 75.4 | 1141 | 461 | 1158 |
| AC#50 | 75.4 | 77.8 | 1158 | 468 | 1175 |
| AC#51 | 77.8 | 80.3 | 1175 | 475 | 1192 |
| AC#52 | 80.3 | 82.8 | 1192 | 482 | 1209 |
| AC#53 | 82.8 | 85.3 | 1209 | 489 | 1225 |
| AC#54 | 85.3 | 87.9 | 1225 | 496 | 1242 |
| AC#55 | 87.9 | 90.5 | 1242 | 502 | 1259 |
| AC#56 | 90.5 | 93.1 | 1259 | 509 | 1275 |
| AC#57 | 93.1 | 95.7 | 1275 | 516 | 1291 |
| AC#58 | 95.7 | 98.4 | 1291 | 522 | 1307 |
| AC#59 | 98.4 | 101 | 1307 | 529 | 1323 |
| AC#60 | 101 | 104 | 1323 | 536 | 1339 |

TABLE 5

| Number of Accelerating Cell | Energy (MeV/U) Injection | Emission | Size (mm) L$REC | L$WIND | L$SEND |
|---|---|---|---|---|---|
| AC#61 | 104 | 107 | 1339 | 541 | 1354 |
| AC#62 | 107 | 109 | 1354 | 548 | 1369 |
| AC#63 | 109 | 112 | 1369 | 555 | 1384 |
| AC#64 | 112 | 115 | 1384 | 561 | 1399 |
| AC#65 | 115 | 118 | 1399 | 567 | 1414 |
| AC#66 | 118 | 120 | 1414 | 573 | 1429 |
| AC#67 | 120 | 123 | 1429 | 579 | 1444 |
| AC#68 | 123 | 126 | 1444 | 585 | 1458 |
| AC#69 | 126 | 129 | 1458 | 591 | 1473 |
| AC#70 | 129 | 132 | 1473 | 597 | 1487 |
| AC#71 | 132 | 135 | 1487 | 603 | 1501 |
| AC#72 | 135 | 138 | 1501 | 609 | 1515 |
| AC#73 | 138 | 141 | 1515 | 614 | 1528 |
| AC#74 | 141 | 144 | 1528 | 619 | 1541 |
| AC#75 | 144 | 147 | 1541 | 625 | 1555 |
| AC#76 | 147 | 150 | 1555 | 631 | 1568 |
| AC#77 | 150 | 153 | 1568 | 636 | 1582 |
| AC#78 | 153 | 156 | 1582 | 642 | 1595 |
| AC#79 | 156 | 159 | 1595 | 647 | 1608 |
| AC#80 | 159 | 162 | 1608 | 653 | 1621 |
| AC#81 | 162 | 165 | 1621 | 658 | 1634 |
| AC#82 | 165 | 168 | 1634 | 663 | 1647 |
| AC#83 | 168 | 171 | 1647 | 669 | 1659 |
| AC#84 | 171 | 174 | 1659 | 674 | 1671 |
| AC#85 | 174 | 178 | 1671 | 679 | 1684 |
| AC#86 | 178 | 181 | 1684 | 684 | 1697 |
| AC#87 | 181 | 184 | 1697 | 689 | 1709 |
| AC#88 | 184 | 188 | 1709 | 694 | 1721 |
| AC#89 | 188 | 191 | 1721 | 699 | 1733 |
| AC#90 | 191 | 194 | 1733 | 704 | 1745 |

TABLE 6

| Number of Accelerating Cell | Energy (MeV/U) Injection | Emission | Size (mm) L$REC | L$WIND | L$SEND |
|---|---|---|---|---|---|
| AC#91 | 194 | 198 | 1745 | 709 | 1757 |
| AC#92 | 198 | 201 | 1757 | 714 | 1769 |
| AC#93 | 201 | 204 | 1769 | 719 | 1780 |
| AC#94 | 204 | 207 | 1780 | 723 | 1791 |
| AC#95 | 207 | 211 | 1791 | 728 | 1802 |
| AC#96 | 211 | 214 | 1802 | 732 | 1813 |
| AC#97 | 214 | 217 | 1813 | 737 | 1824 |
| AC#98 | 217 | 221 | 1824 | 741 | 1835 |
| AC#99 | 221 | 224 | 1835 | 746 | 1845 |
| AC#100 | 224 | 227 | 1845 | 750 | 1855 |
| AC#101 | 227 | 231 | 1855 | 754 | 1866 |
| AC#102 | 231 | 234 | 1866 | 758 | 1876 |
| AC#103 | 234 | 237 | 1876 | 763 | 1886 |
| AC#104 | 237 | 241 | 1886 | 767 | 1897 |
| AC#105 | 241 | 244 | 1897 | 771 | 1907 |
| AC#106 | 244 | 248 | 1907 | 776 | 1917 |
| AC#107 | 248 | 251 | 1917 | 780 | 1927 |
| AC#108 | 251 | 255 | 1927 | 784 | 1937 |
| AC#109 | 255 | 258 | 1937 | 788 | 1947 |
| AC#110 | 258 | 262 | 1947 | 792 | 1956 |
| AC#111 | 262 | 265 | 1956 | 796 | 1966 |
| AC#112 | 265 | 269 | 1966 | 800 | 1975 |
| AC#113 | 269 | 272 | 1975 | 804 | 1984 |
| AC#114 | 272 | 276 | 1984 | 807 | 1993 |
| AC#115 | 276 | 279 | 1993 | 811 | 2002 |
| AC#116 | 279 | 283 | 2002 | 815 | 2011 |
| AC#117 | 283 | 286 | 2011 | 818 | 2020 |
| AC#118 | 286 | 290 | 2020 | 822 | 2029 |
| AC#119 | 290 | 293 | 2029 | 826 | 2037 |
| AC#120 | 293 | 297 | 2037 | 829 | 2046 |

TABLE 7

| Number of Accelerating Cell | Energy (MeV/U) Injection | Emission | Size (mm) L$REC | L$WIND | L$SEND |
|---|---|---|---|---|---|
| AC#121 | 297 | 300 | 2046 | 832 | 2054 |
| AC#122 | 300 | 304 | 2054 | 836 | 2062 |
| AC#123 | 304 | 307 | 2062 | 839 | 2071 |
| AC#124 | 307 | 311 | 2071 | 843 | 2079 |
| AC#125 | 311 | 314 | 2079 | 846 | 2087 |
| AC#126 | 314 | 318 | 2087 | 849 | 2094 |
| AC#127 | 318 | 321 | 2094 | 852 | 2102 |
| AC#128 | 321 | 325 | 2102 | 856 | 2110 |
| AC#129 | 325 | 328 | 2110 | 859 | 2117 |
| AC#130 | 328 | 332 | 2117 | 862 | 2125 |
| AC#131 | 332 | 336 | 2125 | 865 | 2133 |
| AC#132 | 336 | 339 | 2133 | 868 | 2141 |
| AC#133 | 339 | 343 | 2141 | 872 | 2149 |
| AC#134 | 343 | 347 | 2149 | 875 | 2156 |
| AC#135 | 347 | 351 | 2156 | 878 | 2163 |
| AC#136 | 351 | 354 | 2163 | 881 | 2171 |
| AC#137 | 354 | 358 | 2171 | 884 | 2178 |
| AC#138 | 358 | 362 | 2178 | 887 | 2185 |
| AC#139 | 362 | 365 | 2185 | 890 | 2192 |
| AC#140 | 365 | 369 | 2192 | 893 | 2199 |
| AC#141 | 369 | 373 | 2199 | 896 | 2206 |
| AC#142 | 373 | 376 | 2206 | 898 | 2213 |
| AC#143 | 376 | 380 | 2213 | 901 | 2220 |
| AC#144 | 380 | 384 | 2220 | 904 | 2227 |
| AC#145 | 384 | 388 | 2227 | 907 | 2233 |
| AC#146 | 388 | 391 | 2233 | 909 | 2240 |
| AC#147 | 391 | 395 | 2240 | 912 | 2246 |
| AC#148 | 395 | 399 | 2246 | 915 | 2253 |
| AC#149 | 399 | 402 | 2253 | 917 | 2259 |
| AC#150 | 402 | 406 | 2259 | 920 | 2265 |

TABLE 8

| Number of Accelerating Cell | Energy (MeV/U) Injection | Emission | Size (mm) L$REC | L$WIND | L$SEND |
|---|---|---|---|---|---|
| AC#151 | 406 | 410 | 2265 | 923 | 2271 |
| AC#152 | 410 | 413 | 2271 | 925 | 2277 |
| AC#153 | 413 | 417 | 2277 | 928 | 2283 |
| AC#154 | 417 | 421 | 2283 | 930 | 2289 |
| AC#155 | 421 | 425 | 2289 | 933 | 2295 |
| AC#156 | 425 | 428 | 2295 | 935 | 2301 |
| AC#157 | 428 | 431 | 2301 | 937 | 2307 |

As shown in FIGS. 10A to 10F, an accelerating electrode tube and a dummy electrode tube are embedded in each accelerating cell. The sizes of the accelerating electrode tube and the dummy electrode tube are the same for all accelerating cells. More specifically, in each accelerating cell, the embedded accelerating electrode tube has a length of 23000 mm (23 m), the embedded dummy electrode tube has a length of 200 mm, and an electrode gap therebetween is 100 mm. Furthermore, as shown in FIGS. 11A to 11E and FIGS. 12A to 12E, four electrode plates, i.e. a sending electrode plate U, a sending electrode plate D, a receiving electrode plate U, and a receiving electrode plate D, are embedded in each accelerating cell. As presented in Tables 3 to 8, the sizes and locations of the four electrode plates differ for each number.

Figure 14A:
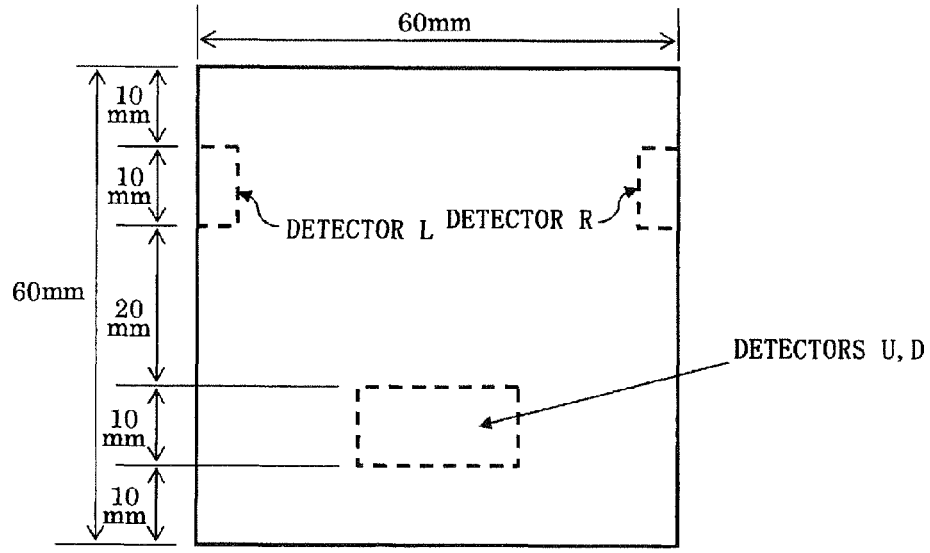
FIG. 14A is a plan view showing a configuration of a detection cell.
Figure 14B:
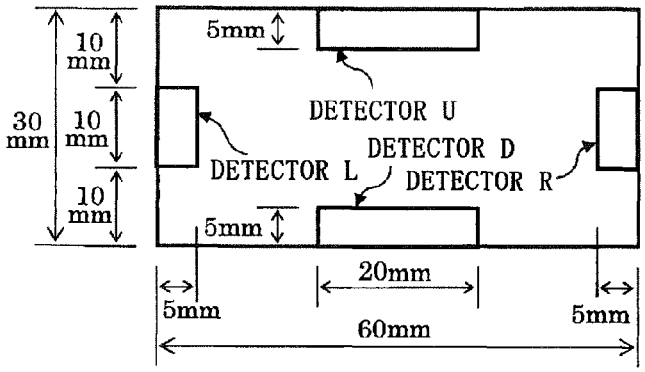
FIG. 14B is a front view showing a configuration of a detection cell.
Figure 14C:
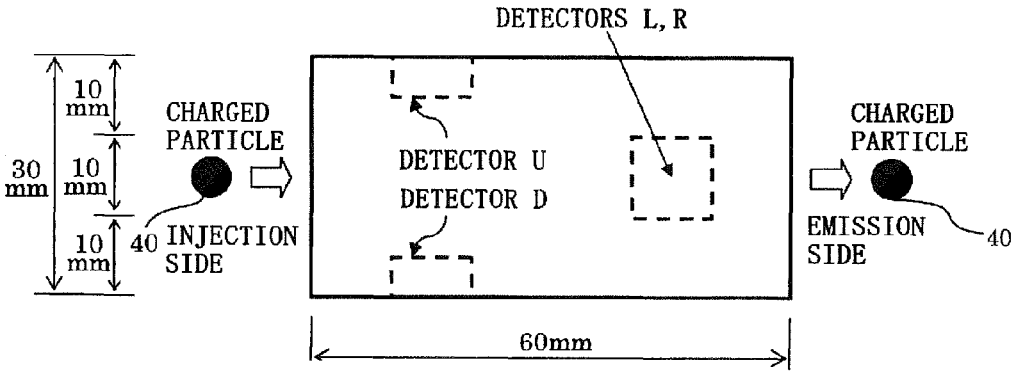
FIG. 14C is a side view showing a configuration of a detection cell.

The adjustment unit 42 is constituted by 157 adjustment cells TU#1 to TU#157, and the detection unit 43 is constituted by 157 detection cells DT#1 to DT#157. FIGS. 13A to 13E show a configuration of an adjustment cell. Four electrode plates, i.e. a vertical adjustment electrode plate U, a vertical adjustment electrode plate D, a horizontal adjustment electrode plate L, and a horizontal adjustment electrode plate R, are embedded in each adjustment cell. In all adjustment cells, these four electrode plates (the vertical adjustment electrode plates U and D and the horizontal adjustment electrode plates L and R) have the same size, and the same electrode plate is placed at the same location. FIGS. 14A to 14C show a configuration of a detection cell. Four charged particle detectors, i.e. detectors U, D, L and R, are embedded in each detection cell. In all detection cells, these four detectors (U, D, L and R) have the same size, and the same detector is placed at the same location.

Figure 15:
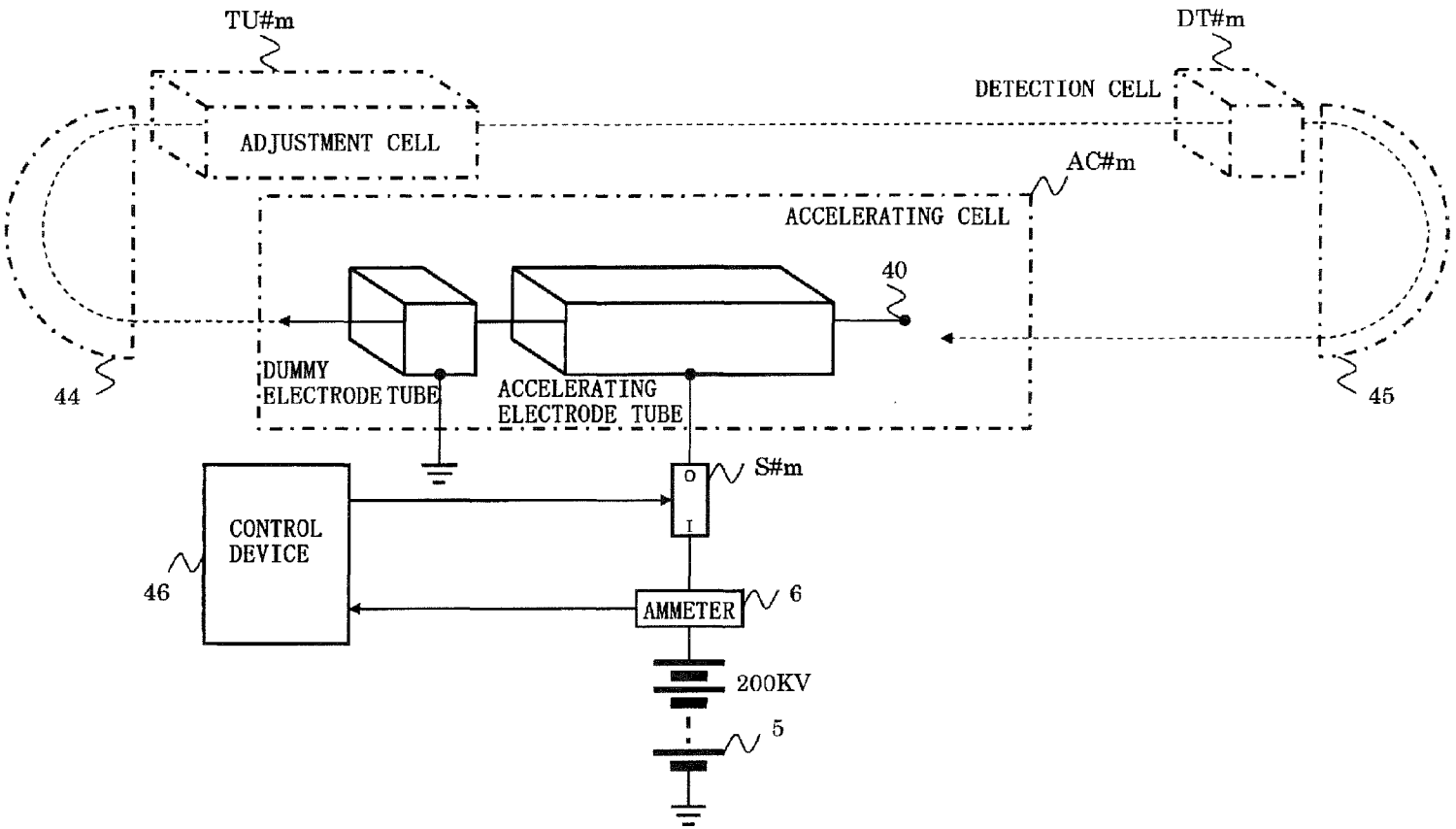
FIG. 15 is a diagram for explaining an accelerating operation of an accelerating cell.

The following describes operations of the spiral-trajectory charged particle accelerator configured in the above manner. As with Embodiment 1, the following description provides an example in which a hexavalent carbon ion is accelerated. That is to say, the following describes operations in which a hexavalent carbon ion is injected as the charged particle 40 at an energy of 2 MeV/u and is accelerated to about 430 MeV/u. Note that the following description is provided under the assumption that permanent magnets with a magnetic field strength of 1.5 tesla are used as the bending magnets 44 and 45. As shown in FIG. 15, the charged particle 40 is accelerated by a difference in electric potential between the accelerating electrode tube and the dummy electrode tube embedded in an accelerating cell AC#m. In FIG. 15, a controller 46 constantly outputs "0" to a switching circuit S#m, and therefore the accelerating electrode tube in the accelerating cell AC#m is at ground potential. When the pulsed ion beam of the charged particle 40 is injected, the controller 46 outputs "1" to the switching circuit S#m at a timing when the leading edge of the pulsed ion beam substantially reaches the center of the accelerating electrode tube, thereby placing the accelerating electrode tube at an electric potential of 200 kV. When the pulsed ion beam is emitted from the accelerating electrode tube, it is accelerated by a difference in electric potential between the accelerating electrode tube and the dummy electrode tube. At a timing when the acceleration has been completed, i.e. when the ion beam has passed through the dummy electrode, the controller 46 outputs "0" to the switching circuit S#m, thus resetting the electric potential of the accelerating electrode tube to ground potential. The ammeter 6 measures an accelerating current generated when the ion beam is accelerated, and notifies the controller 46 of the measured accelerating current. A configuration of the controller 46 for checking the normality of the accelerating operation or correcting timings to apply the accelerating voltage is similar to that of Embodiment 1 of the present invention.

The pulsed ion beam emitted from the dummy electrode passes through the bending magnet 44, an adjustment cell TU#m, a detection cell DT#m, and the bending magnet 45, and is injected into the accelerating cell AC#m again to be further accelerated through the above operation. By repeating this, the pulsed ion beam of the charged particle 40 is accelerated multiple times in the same accelerating cell.

Figure 16:
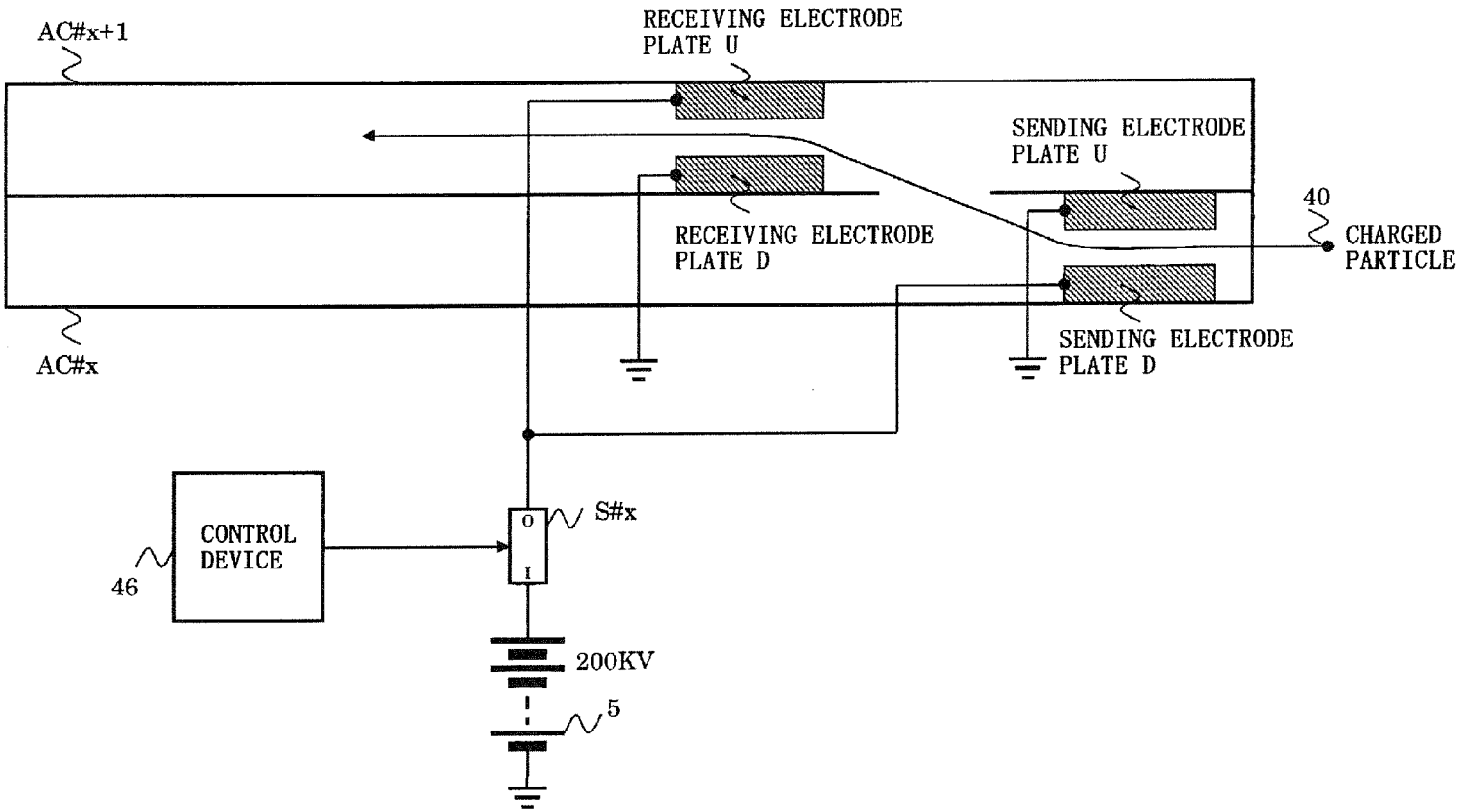
FIG. 16 is a diagram for explaining transfer between accelerating cells (from an odd-numbered accelerating cell to an even-numbered accelerating cell).

Once the accelerating energy of the pulsed ion beam has reached a predetermined energy through multiple accelerations in one accelerating cell, the controller 46 transfers the pulsed ion beam from an accelerating cell AC#x to an accelerating cell AC#x+1 by operating the sending electrode plates and the receiving electrode plates of the accelerating cells. First, a description is given of an operation for transferring the pulsed ion beam of the charged particle 40 from an odd-numbered accelerating cell to an even-numbered accelerating cell. FIG. 16 is a schematic diagram for explaining this operation. Here, x is an odd integer. While the controller 46 constantly outputs "0" to the switching circuit S#x, all electrode plates are at ground potential, and the pulsed ion beam of the charged particle 40 proceeds straight. To transfer the pulsed ion beam, the controller 46 outputs "1" to the switching circuit S#x, thus placing the sending electrode plate D and the receiving electrode plate U at an electric potential of 200 kV. The pulsed ion beam moves in a vertical direction due to an electric field generated by the four electrode plates, and transfers from the accelerating cell AC#x to the accelerating cell AC#x+1 via receiving holes provided in the accelerating cells. The controller 46 outputs "0" to the switching circuit S#x at a timing when the transfer has been completed, thereby resetting the electric potential of the four electrode plates to ground potential. Further acceleration of the charged particle 40 is continued in the accelerating cell AC#x+1.

Figure 17:
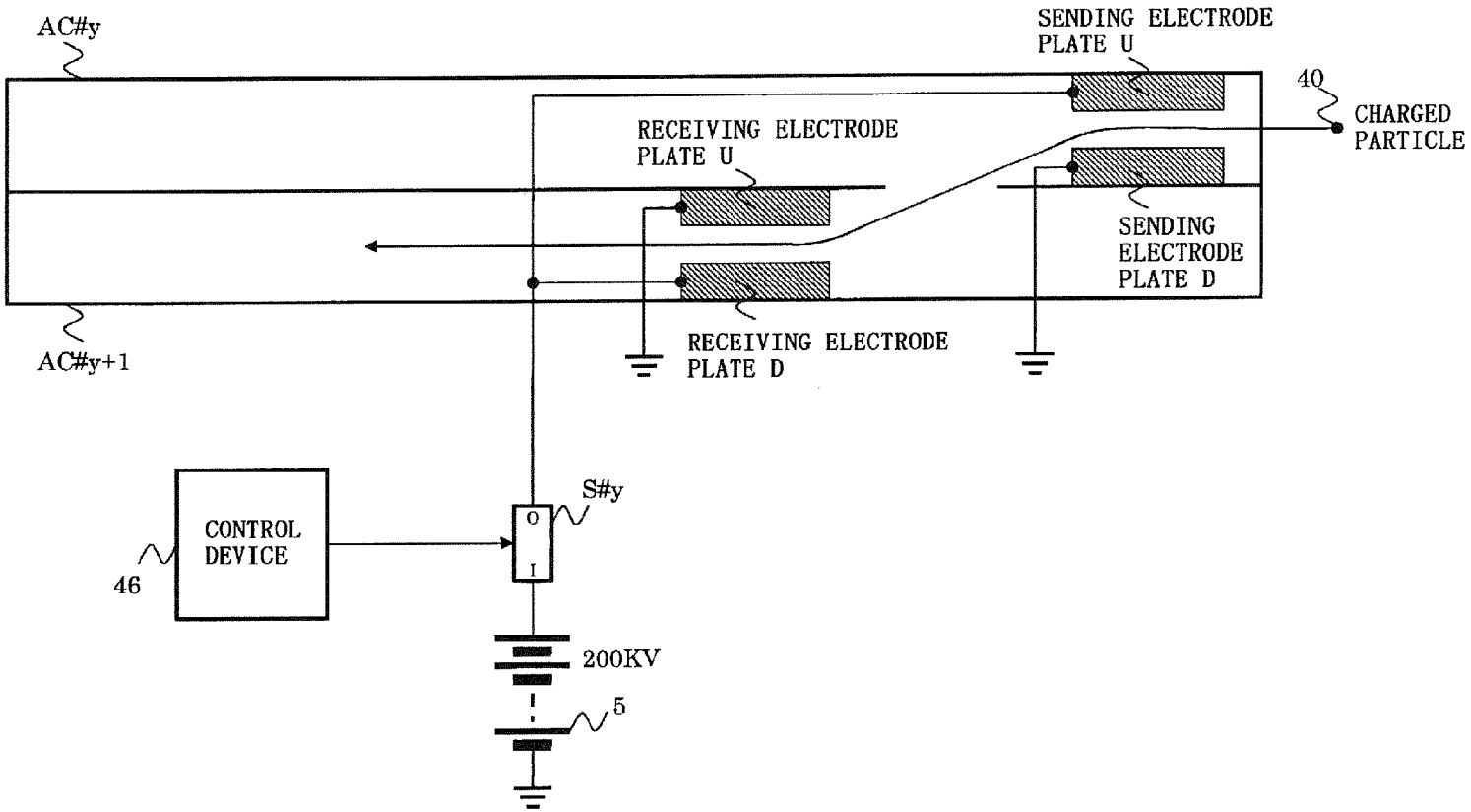
FIG. 17 is a diagram for explaining transfer between accelerating cells (from an even-numbered accelerating cell to an odd-numbered accelerating cell).

Next, a description is given of an operation for transferring the pulsed ion beam from an even-numbered accelerating cell to an odd-numbered accelerating cell. FIG. 17 is a schematic diagram for explaining this operation. Here, y is an even integer. When the controller 46 outputs "1" to a switching circuit S#y, the electric potential of the sending electrode U in an accelerating cell S#y and the receiving electrode D in an accelerating cell S#y+1 becomes 200 kV. As a result, an electric field is generated, due to which the pulsed ion beam of the charged particle 40 transfers from the accelerating cell AC#y to the accelerating cell AC#y+1 via receiving holes provided in the accelerating cells. The controller 46 outputs "0" to the switching circuit S#y at a timing when the transfer has been completed, thereby resetting the electric potential of the four electrode plates to ground potential. Further acceleration of the charged particle 40 is continued in the accelerating cell AC#y+1.

That is to say, in the spiral-trajectory charged particle accelerator shown in FIGS. 4A and 4B, a large accelerating energy is generated by an assembly of distributed linear trajectory accelerators called accelerating cells. The controller 46 performs traffic control so that only one pulsed ion beam is present in each accelerating cell at any time. In this way, even if the speed of the charged particle approaches the speed of light, acceleration control can be independently executed for each accelerating cell in consideration of a mass increase caused by relativistic effects. Furthermore, since the beam is accumulated in each accelerating cell, the beam can be continuously supplied.

Figure 18:
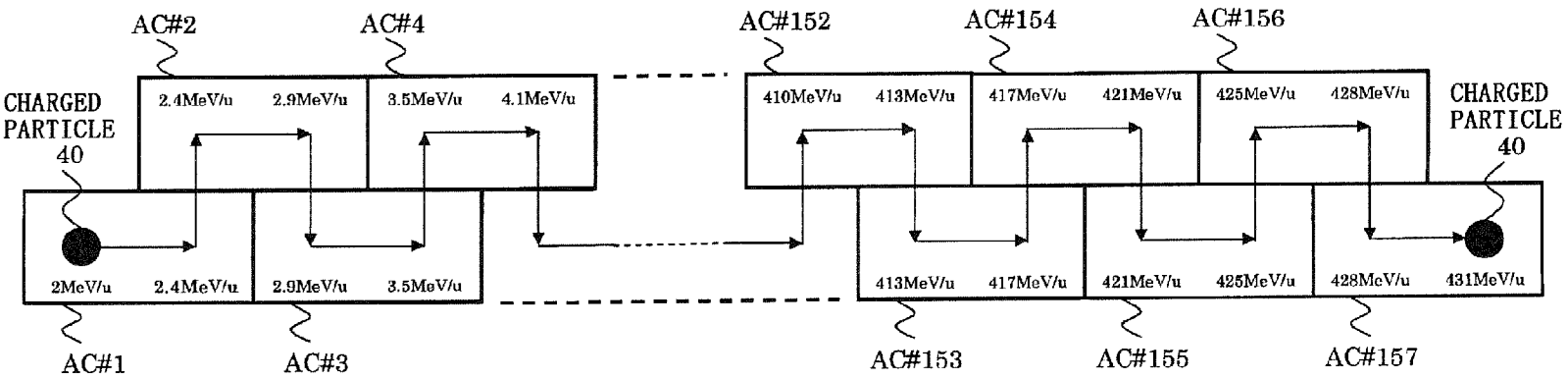
FIG. 18 is a diagram for explaining a trajectory of a charged particle subjected to distributed acceleration.

FIG. 18 is a diagram for explaining distributed acceleration by the accelerating cells. In FIG. 18, a charged particle (hexavalent carbon ion) is injected to an accelerating cell AC#1 at an accelerating energy of 2 MeV/u. The controller 46 accelerates the charged particle via the accelerating electrode tube in the accelerating cell AC#1 four times, and as a result, the charged particle is accelerated to 2.4 MeV/u. Once the charged particle has been accelerated to 2.4 MeV/u, the controller 46 places the sending electrode plate D in the accelerating cell AC#1 and the receiving electrode plate U in an accelerating cell AC#2 at 200 kV, thereby transferring the charged particle to the accelerating cell AC#2. In the accelerating cell AC#2, the charged particle injected at 2.4 MeV/u is accelerated via the embedded accelerating electrode tube five times, and as a result, the charged particle is accelerated to an energy of 2.9 MeV/u. Once the charged particle has been accelerated to 2.9 MeV/u, the controller 46 transfers the charged particle to an accelerating cell AC#3 to further accelerate the charged particle. In this way, as the accelerating energy increases, the charged particle is transferred to outer accelerating cells. In the last accelerating cell AC#157, the charged particle is accelerated to the extent that the injection energy is 428 MeV/u and the emission energy is 432 MeV/u. The injection energy and the emission energy for all accelerating cells AC#1 to AC#157 are presented in Tables 3 to 8. That is to say, the spiral-trajectory particle accelerator shown in FIGS. 4A and 4B can yield the following energy gain.

Figure 19:
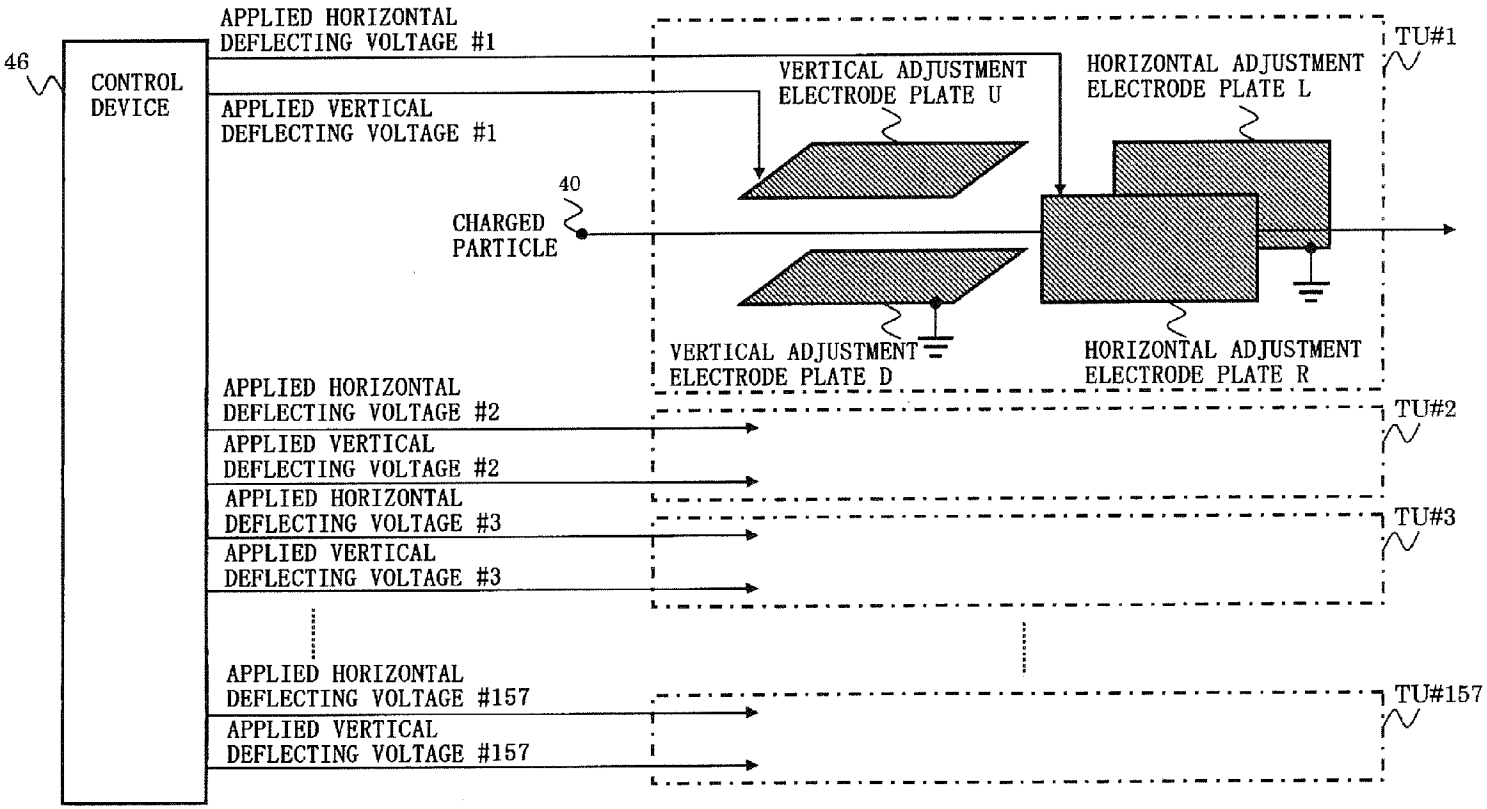
FIG. 19 is a diagram for explaining an operation of an adjustment cell.

Injection radius: 0.27 m
Emission radius: 4.99 m
Injection energy: 2 MeV/u
Emission energy: 432 MeV/u Next, a description is given of the functions of the adjustment cells TU#1 to TU#157 with reference to FIG. 19. In FIG. 19, the controller 46 supplies voltage of an appropriate value to two electrode plates embedded in each adjustment cell, namely the vertical adjustment electrode plate U and the horizontal adjustment electrode plate R, via an analog output device. The electric potential of the vertical adjustment electrode plate D and the horizontal adjustment electrode plate L is fixed at ground potential. Due to electric fields generated by the vertical adjustment electrode plates U and D and the horizontal adjustment electrode plates L and R, the trajectory along which the charged particle 40 travels is corrected in vertical (up and down) and horizontal (left and right) directions. For example, these electric fields correct a minute shift of the trajectory caused by a subtle deviation between magnetic field strengths of the bending magnets 44 and 45, engineering accuracy, and the like. In a start-up test for the device, the value of the analog output is adjusted to an appropriate value for each level of accelerating energy of the charged particle 40. The controller 46 therefore outputs the adjusted value in accordance with the corresponding accelerating energy. With the installation of the adjustment cells TU#1 to TU#157, a certain level of quality error in the bending magnets 44 and 45 can be mitigated, and therefore it is possible to reduce the cost of magnets, shorten a time period required for start-up adjustment, and the like. As set forth above, when the trajectory of the charged particle has shifted from the assumed trajectory due to, for example, engineering accuracy of the accelerating electrode tubes or bending magnets, the trajectory of the charged particle can be corrected to the original trajectory by the electric fields generated by the adjustment voltage applied to the adjustment electrode plates. Furthermore, as the trajectory of the accelerated charged particle can be finely adjusted, manufacturing errors and installation errors can be mitigated, and therefore it is possible to provide an accelerator with which operations for start-up adjustment are easy.

Figure 20:
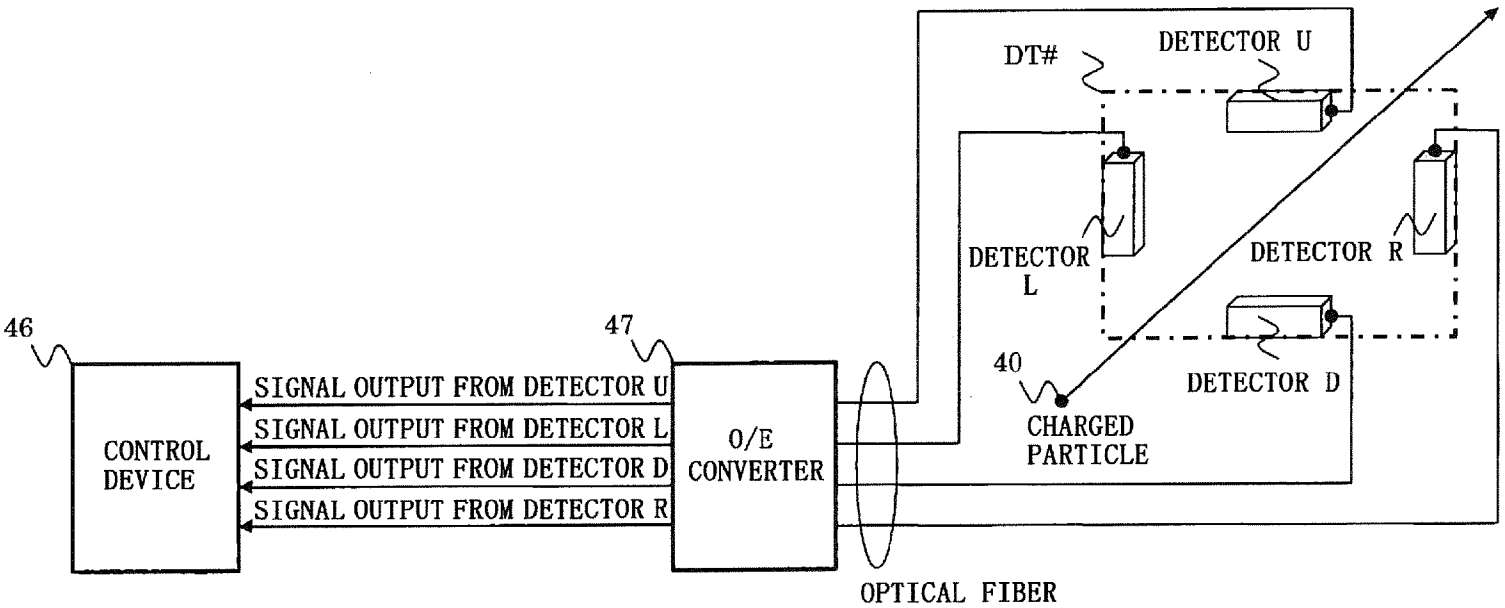
FIG. 20 is a diagram for explaining an operation of a detection cell.

The following describes the functions of the detection cells with reference to FIG. 20. FIG. 20 is a schematic diagram for explaining an example in which scintillators are used for charged particle detectors mounted in the detection cells TU#1 to TU#157. After the charged particle 40 is emitted from the adjustment cell TU#m, it is injected into the detection cell DT#m. At this time, if the charged particle 40 is traveling along the correct trajectory, the charged particle 40 will pass through the detection cell DT#m and be injected into the bending magnet 45 without being injected into the four detectors in the detection cell DT#m, i.e. the detectors U, D, L and R. The controller 46 monitors emission of light by the scintillators via an optical/electrical converter 47, and if it has confirmed emission of light by the scintillators, namely injection of the charged particle 40 into the detectors, it immediately warns the operator to that effect and stops the accelerating operation to ensure the safety of the device. By thus mounting the charged particle detectors in areas where the accelerated charged particle should not pass when the device is operating normally, it is possible to confirm whether or not the accelerating operation is being performed normally. Furthermore, as it is possible to immediately detect deviation of the trajectory of the accelerated charged particle from a predetermined trajectory and stop the accelerating operation, a safe accelerator can be provided.

As has been described above, in the present embodiment, the accelerating electrode tubes are connected in a loop via the bending magnets, that is to say, there is no need to arrange the accelerating electrode tubes in a linear fashion, and therefore the total length of the accelerator can be reduced. Furthermore, by selecting bending magnets with appropriate shapes and magnetic field strengths, it is possible to design a trajectory along which a charged particle accelerated by an accelerating electrode tubes returns to the same accelerating electrode tube, and therefore the charged particle can be accelerated multiple times by one accelerating electrode tube. Since a charged particle can be thus accelerated multiple times by one accelerating electrode tube with the use of bending magnets, a high energy gain can be yielded. Furthermore, when permanent magnets are used as the bending magnets, an accelerator that consumes low power during operation can be provided.

Embodiment 3

Figure 21:
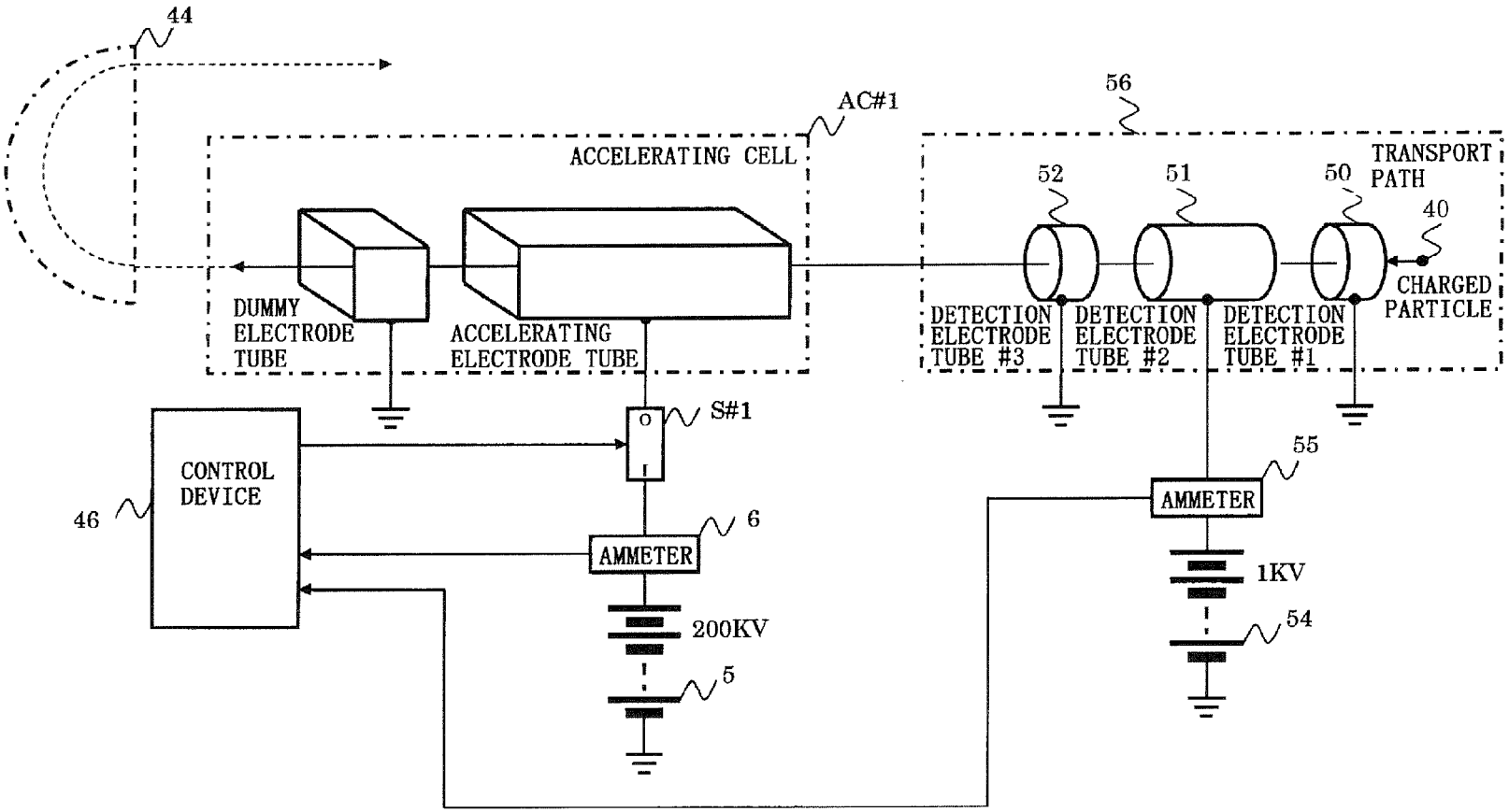
FIG. 21 shows a configuration of a charged particle measurement system pertaining to Embodiment 3.

FIG. 21 is a schematic diagram showing a configuration of a charged particle detection system pertaining to Embodiment 3 of the present invention. In FIG. 21, 40 denotes a charged particle, 50 denotes a detection electrode tube #1, 51 denotes a detection electrode tube #2, 52 denotes a detection electrode tube #3, 54 denotes a 1-kV direct current power supply, and 55 denotes an ammeter. In order to accelerate a charged particle (hexavalent carbon ion) using the spiral-trajectory particle accelerator shown in FIGS. 4A and 4B, it is necessary to accelerate the charged particle to 2 MeV/u in a pre-accelerator. In the example shown in FIG. 21, a charged particle that has been accelerated to 2 MeV/u is injected into the first accelerating cell AC#1 of the spiral-trajectory particle accelerator via a transport path 56.

The following describes operations of the charged particle detection system configured in the above manner. A fixed voltage is applied to the three detection electrode tubes placed in a rear portion of the transport path 56. More specifically, ground potential is applied to the detection electrode tubes #1 and #3, whereas an electric potential of 1 kV is applied to the detection electrode tube #2. The charged particle 40 passes through these detection electrode tubes before being injected into the accelerating cell AC#1 via the transport path 56. At this time, the charged particle 40 is decelerated by a difference in electric potential between the detection electrode tubes #1 and #2, and then accelerated again by a difference in electric potential between the detection electrode tubes #2 and #3. As the values of the decelerating energy and the accelerating energy are substantially the same, the accelerating energy of the charged particle 40 is not substantially changed by the charged particle 40 passing through these detection electrode tubes.

When the charged particle 40 is decelerated in the gap between the detection electrode tubes #1 and #2, a negative accelerating current flows through the 1-kV direct current power supply 54. On the other hand, when the charged particle 40 is accelerated in the gap between the detection electrode tubes #2 and #3, a positive accelerating current flows through the 1-kV direct current power supply 54. The ammeter 55 measures these positive and negative accelerating currents and notifies the controller 46 of the measured accelerating currents. The controller 46 can obtain the location, the speed and the total amount of charge of the charged particle 40 based on the values measured by the ammeter 55. Based on these data, the controller 46 can calculate an appropriate timing to apply the accelerating voltage (200 kV) to the accelerating electrode tube embedded in the first accelerating cell AC#1.

Figure 22:
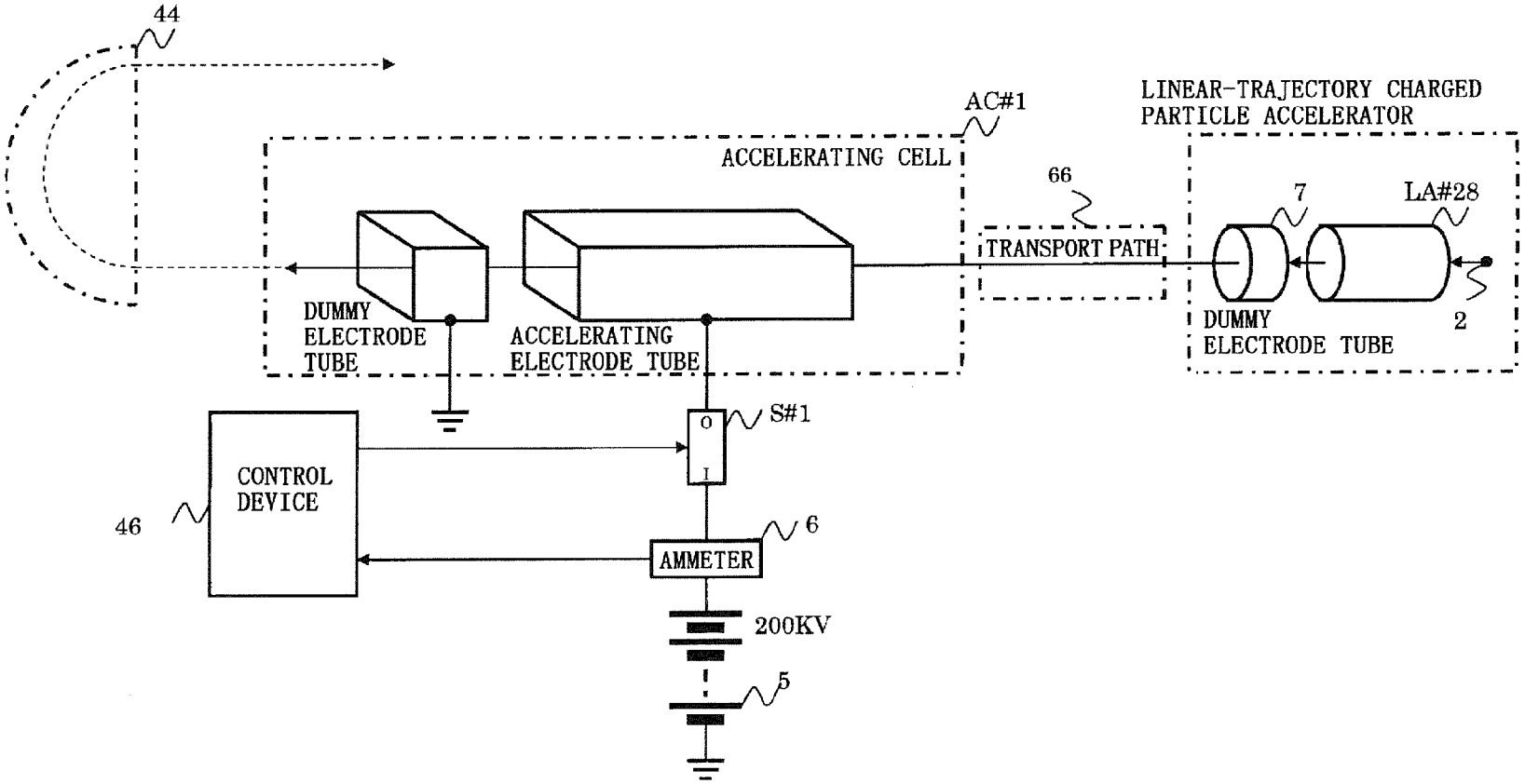
FIG. 22 shows a configuration of another charged particle measurement system.
Figure 23A:
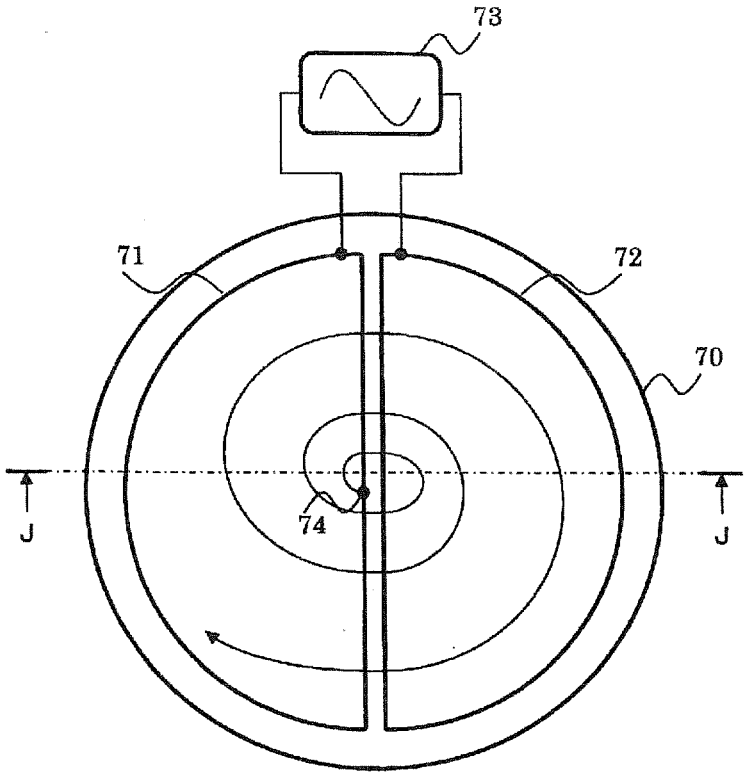
FIG. 23A Prior Art
FIG. 23A shows a configuration of a conventional charged particle accelerator with a spiral trajectory.
Figure 23B:
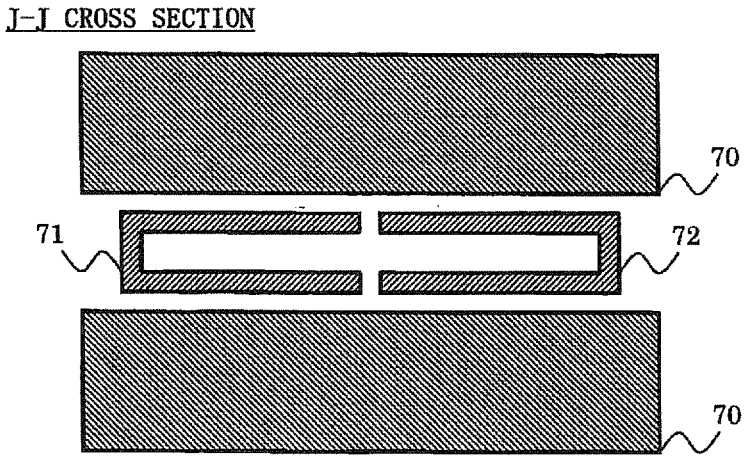
FIG. 23B Prior Art
FIG. 23B is a cross-sectional view of the charged particle accelerator with the spiral trajectory shown in FIG. 23A.

Note that when the linear-trajectory charged particle accelerator shown in FIG. 1 is used as a pre-accelerator, the detection electrode tubes are not necessary. As shown in FIG. 22, provided that the length of a transport path 66 is identified, an appropriate timing to apply the accelerating voltage to the accelerating electrode tube embedded in the accelerating cell AC#1 can be calculated based on data of a timing to apply the accelerating voltage to the accelerating electrode tube LA#28, and therefore the acceleration can be seamlessly continued without needing to provide the detection electrode tubes.

Other Embodiments

The above Embodiment 2 has described a configuration for changing a direction in which the charged particle travels by using the bending magnets so as to make the charged particle pass through the same accelerating electrode tube multiple times. However, the present invention is not limited in this way. Alternatively, it is possible to have a configuration in which a plurality of accelerating electrode tubes are arranged in a non-linear fashion with bending magnets provided between neighboring accelerating electrode tubes. With this configuration, the direction in which the charged particle travels can be changed by the bending magnets so that the charged particle passes through the accelerating electrode tubes arranged in a non-linear fashion in sequence. This type of charged particle accelerator can be made shorter and smaller than a linear trajectory accelerator. A conventional charged particle accelerator generates the accelerating voltage using a radio-frequency power supply, and therefore cannot be made smaller as the distance of a gap between accelerating electrode tubes always needs have a constant value. The aforementioned small charged particle accelerator is advantageous in that it can be installed in a place with a limited space, such as on a ship.

INDUSTRIAL APPLICABILITY

A charged particle accelerator pertaining to the present invention is useful as a linear trajectory accelerator and a spiral trajectory accelerator, and a method for accelerating charged particles pertaining to the present invention is useful as a method for accelerating charged particles that uses these charged particle accelerators.

DESCRIPTION OF REFERENCE NUMERALS

1 ION SOURCE
2 CHARGED PARTICLE
3 20-kV DIRECT CURRENT POWER SUPPLY
4 AMMETER
5 200-kV DIRECT CURRENT POWER SUPPLY
6 AMMETER
7 DUMMY ELECTRODE TUBE
8 CONTROL DEVICE
LA#1 to LA#28 ACCELERATING ELECTRODE TUBE
S#1 to S#28 SWITCHING CIRCUIT
15 VARIABLE VOLTAGE POWER SUPPLY
40 CHARGED PARTICLE
41 ACCELERATION UNIT
42 ADJUSTMENT UNIT
43 DETECTION UNIT
44 BENDING MAGNET

45 BENDING MAGNET
46 CONTROL DEVICE
47 PHOTOELECTRIC CONVERTER
AC#1 to AC#157 ACCELERATING CELL
TU#1 to TU#157 ADJUSTMENT CELL
DT#1 to DT#157 DETECTION CELL
50 DETECTION ELECTRODE TUBE #1
51 DETECTION ELECTRODE TUBE #2
52 DETECTION ELECTRODE TUBE #3
54 1-kV DIRECT CURRENT POWER SUPPLY
55 AMMETER
56 TRANSPORT PATH
66 TRANSPORT PATH

The invention claimed is:

1. A charged particle accelerator comprising:

a charged particle generation source for emitting a charged particle;

an accelerating electrode tube through which the charged particle emitted from the charged particle generation source passes and which is for accelerating the charged particle that passes;

a drive circuit having a DC voltage supply for applying a DC voltage to the accelerating electrode tube, and a switch for switching between connecting the accelerating electrode tube to the DC voltage supply for applying the DC voltage for accelerating the charged particle to the accelerating electrode tube and disconnecting the accelerating electrode tube from the DC voltage supply; and a control unit for controlling the switch to connect the accelerating electrode tube to the DC voltage supply so that application of the DC voltage to the accelerating electrode tube is started while the charged particle is traveling through the accelerating electrode tube.

2. The charged particle accelerator according to claim 1, wherein the accelerating electrode tube is provided in plurality, the plurality of accelerating electrode tubes are arranged in a linear fashion, and the charged particle emitted from the charged particle generation source passes through the plurality of accelerating electrode tubes in sequence, the switch is provided in plurality corresponding to each of the accelerating electrodes, and the control unit controls the switches to connect the DC voltage supply to any accelerating electrode tube through which the charged particle is traveling, thus applying the DC voltage to the plurality of accelerating electrode tubes in sequence.

3. The charged particle accelerator according to claim 2, further comprising an ammeter for measuring an accelerating current that is generated in an accelerating electrode tube when the charged particle passes through the accelerating electrode tube, wherein the control unit adjusts a timing to connect an accelerating electrode tube to the DC voltage supply based on a result of measurement of the accelerating current by the ammeter.

4. The charged particle accelerator according to claim 2, wherein the drive circuit is capable of changing a value of voltage applied to an accelerating electrode tube.

5. The charged particle accelerator according to claim 2, further comprising a detection unit for detecting whether or not the charged particle accelerated by an accelerating electrode tube is traveling along a predetermined trajectory, wherein the control unit stops the drive circuit when the detection unit has detected that the charged particle is not traveling along the predetermined trajectory.

6. The charged particle accelerator according to claim 1, further comprising a bending magnet for changing a traveling direction of the charged particle that has passed through the accelerating electrode tube.

7. The charged particle accelerator according to claim 6, wherein the drive circuit is capable of changing a value of voltage applied to an accelerating electrode tube.

8. The charged particle accelerator according to claim 6, further comprising a detection unit for detecting whether or not the charged particle accelerated by an accelerating electrode tube is traveling along a predetermined trajectory, wherein the control unit stops the drive circuit when the detection unit has detected that the charged particle is not traveling along the predetermined trajectory.

9. The charged particle accelerator according to claim 6, wherein the bending magnet changes the traveling direction of the charged particle that has passed through the accelerating electrode tube so as to cause the charged particle to pass through the same accelerating electrode tube again, and the control unit controls the switch to connect the DC voltage supply to the accelerating electrode tube while the charged particle is traveling through the accelerating electrode tube, thus applying the DC voltage to the same accelerating electrode tube multiple times.

10. The charged particle accelerator according to claim 9, further comprising an adjustment unit for adjusting the traveling direction of the charged particle to a direction that intersects the traveling direction.

11. The charged particle accelerator according to claim 9, wherein the drive circuit is capable of changing a value of voltage applied to an accelerating electrode tube.

12. The charged particle accelerator according to claim 9, further comprising an ammeter for measuring an accelerating current that is generated in an accelerating electrode tube when the charged particle passes through the accelerating electrode tube, wherein the control unit adjusts a timing to connect an accelerating electrode tube to the DC voltage supply based on a result of measurement of the accelerating current by the ammeter.

13. The charged particle accelerator according to claim 9, further comprising a detection unit for detecting whether or not the charged particle accelerated by an accelerating electrode tube is traveling along a predetermined trajectory, wherein the control unit stops the drive circuit when the detection unit has detected that the charged particle is not traveling along the predetermined trajectory.

14. The charged particle accelerator according to claim 6, further comprising an adjustment unit for adjusting the traveling direction of the charged particle to a direction that intersects the traveling direction.

15. The charged particle accelerator according to claim 6, further comprising an ammeter for measuring an accelerating current that is generated in an accelerating electrode tube when the charged particle passes through the accelerating electrode tube, wherein the control unit adjusts a timing to connect an accelerating electrode tube to the DC voltage supply based on a result of measurement of the accelerating current by the ammeter.

16. The charged particle accelerator according to claim 1, further comprising an ammeter for measuring an accelerating current that is generated in an accelerating electrode tube when the charged particle passes through the accelerating electrode tube, wherein the control unit adjusts a timing to connect the accelerating electrode tube to the DC voltage supply based on a result of measurement of the accelerating current by the ammeter.

17. The charged particle accelerator according to claim 1, wherein the drive circuit is capable of changing a value of DC voltage applied to an accelerating electrode tube.

18. The charged particle accelerator according to claim 1, further comprising a detection unit for detecting whether or not the charged particle accelerated by an accelerating electrode tube is traveling along a predetermined trajectory, wherein the control unit stops the drive circuit when the detection unit has detected that the charged particle is not traveling along the predetermined trajectory.

19. A method for accelerating a charged particle, comprising:

a step of emitting the charged particle from a charged particle generation source so as to cause the charged particle to pass through a plurality of accelerating electrode tubes in sequence; and a step of connecting a DC voltage supply to any accelerating electrode tube through which the charged particle is traveling so that application of the DC voltage to the accelerating electrode tube through which the charged particle is traveling is started while the charged particle is in the accelerating electrode tube, thus applying the voltage for accelerating the charged particle to the plurality of accelerating electrode tubes in sequence.

* * * * *